US005370984A

United States Patent [19]

Takada et al.

[11] Patent Number: 5,370,984

[45] Date of Patent: Dec. 6, 1994

[54] SILVER HALIDE PHOTOGRAPHIC LIGHT-SENSITIVE MATERIAL

[75] Inventors: Shunji Takada; Junichi Yamanouchi, both of Minami-Ashigara, Japan

[73] Assignee: Fuji Photo Film Co., Ltd., Kanagawa, Japan

[21] Appl. No.: 49,444

[22] Filed: Apr. 20, 1993

[30] Foreign Application Priority Data

Apr. 20, 1992 [JP] Japan ..... 4-125470

[51] Int. Cl.[5] ..... G03C 1/005

[52] U.S. Cl. ..... 430/567; 430/545; 430/609; 430/627; 430/228; 430/941

[58] Field of Search ..... 430/567, 941, 545, 371, 430/627, 628, 609, 518

[56] References Cited

U.S. PATENT DOCUMENTS

| | | | |
|---|---|---|---|
| 4,594,308 | 6/1986 | Nakamura et al. | 430/941 |
| 4,933,268 | 6/1990 | Ohno et al. | 430/518 |
| 5,023,162 | 6/1991 | Yamanouchi et al. | 430/518 |
| 5,104,778 | 4/1992 | Yamanouchi et al. | 430/518 |

FOREIGN PATENT DOCUMENTS

| | | |
|---|---|---|
| 0428041 | 5/1991 | European Pat. Off. . |
| 2404193 | 8/1974 | Germany . |
| 1398055 | 6/1975 | United Kingdom . |
| 2090991 | 7/1982 | United Kingdom . |

*Primary Examiner*—Thomas R. Neville

*Attorney, Agent, or Firm*—Birch, Stewart, Kolasch & Birch

[57] ABSTRACT

In a silver halide photographic light-sensitive material having at least one silver halide emulsion layer on a support, at least one of the silver halide emulsion layers contains a light-sensitive silver halide emulsion, in which tabular grains having an aspect ratio of 2 or more occupy 50% or more of a total projected area of silver halide grains, and a polymer represented by Formula (1) below in an amount of $10^{-3}$ to 10 g per mole of the silver halide. In Formula (1), A represents a repeating unit derived from an ethylenic unsaturated monomer having at least one basic nitrogen atom, and B represents a repeating unit, other than A, derived from an ethylenic unsaturated monomer. x and y each represents a percentage by weight. x represents 0.1 to 100, and y represents 0 to 99.9.

$$\text{-}(A)_x\text{-}(B)_y\text{-} \qquad \text{Formula (1)}$$

20 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material and, more particularly, to a silver halide color photographic light-sensitive material and a photographic light-sensitive material for color photography.

2. Description of the Related Art

Recently, requirements for higher performance, particularly higher sensitivities and higher image qualities of silver halide photographic light-sensitive materials have become more and more strict. To meet these requirements, efforts have been made to flatten an emulsion grain into a tabular grain to thereby increase the surface area of the grain. In addition, to improve the response to light of such a tabular grain, refinements have been made by performing spectral sensitization by using a relatively large amount of cyanine spectral sensitizing dyes as well as introducing dislocation lines into the grain and performing selenium sensitization.

In particular, a tabular grain with a high aspect ratio can increase the total surface area of a grain for the same volume and can therefore adsorb a large amount of compounds that determine the photographic sensitivity of an emulsion. In principle, therefore, such a tabular grain is advantageous in increasing sensitivity. In addition, to increase the number of grains contained in an emulsion layer at the same coating silver amount with the total surface area per grain maintained constant, a tabular grain having a high aspect ratio is advantageous in principle. Therefore, the tabular grain with a high aspect ratio possesses, in principle, very good properties in increasing sensitivity and image quality.

It was found, however, that one problem arises in attempting to maximally take advantage of these favorable properties of the tabular grain with a high aspect ratio; the graininess of the tabular grain with a high aspect ratio is degraded when the grain is forced to adsorb a large amount of compounds that determine the photographic sensitivity. This phenomenon is significant when an amount of compounds adsorbed is large or when a time interval in which an emulsion is left to stand in the form of a solution from addition of substances to be adsorbed is long. It is, therefore, crucial to reduce this degradation in graininess as a practical drawback of the tabular grain having a high aspect ratio, thereby sufficiently taking advantage of the preferable properties typical of a tabular grain.

JP-B-43-7541 ("JP-B" means Published Examined Japanese Patent Application) discloses the use of a synthetic polymer having an imidazole group as a protective colloid for use in grain formation instead of gelatin. JP-B-44-14152 discloses the use of a synthetic polymer having an imidazole group as a color turbidity inhibitor. However, these patents do not mention at all the ability of the present invention to prevent degradation in performance caused when a silver halide emulsion comprising tabular grains is aged in the form of a solution; that is, this effect of the present invention is totally unexpected.

SUMMARY OF THE INVENTION

It is an object of the present invention to make a technique of forming an emulsion which has a high sensitivity and high contrast characteristics and is not degraded in photographic characteristics when aged in the form of a solution for a long time period, thereby providing an excellent silver halide photographic light-sensitive material, particularly a high-sensitivity light-sensitive material taking advantage of properties typical of the tabular grain with a high aspect ratio.

The present inventors have made extensive studies and achieved the above object of the present invention by means of items (1) to (17) below:

(1) A silver halide photographic light-sensitive material having at least one silver halide emulsion layer on a support, wherein at least one of the silver halide emulsion layers contains a light-sensitive silver halide emulsion, in which tabular grains having an aspect ratio of 2 or more occupy 50% or more of a total projected area of silver halide grains, and a polymer represented by Formula (1) below in an amount of $10^{-3}$ to 10 g per mole of the silver halide:

$$\text{-}(A)_x\text{-}(B)_y\text{-} \qquad \text{Formula (1)}$$

wherein A represents a repeating unit derived from an ethylenic unsaturated monomer having at least one basic nitrogen atom, B represents a repeating unit, other than A, derived from an ethylenic unsaturated monomer, and x and y each represent a percentage by weight, x representing 0.1 to 100, and y representing 0 to 99.9.

(2) The silver halide light-sensitive material described in item (1) above, wherein 60% (number) or more of the light-sensitive silver halide grains contain dislocation lines.

(3) The silver halide light-sensitive material described in item (1) above, wherein the light-sensitive silver halide grains contained in the emulsion layer is subjected to selenium sensitization.

(4) The silver halide light-sensitive material described in item (1) above, wherein the light-sensitive silver halide grains contained in the emulsion layer is sensitized with cyanine spectral sensitizing dyes.

(5) The silver halide light-sensitive material described in item (1) above, wherein the polymer is represented by Formula (2) below:

$$\text{-}(A)_x\text{-}(B)_y\text{-} \qquad \text{Formula (2)}$$

wherein A represents a repeating unit derived from an ethylenic unsaturated monomer having a heterocyclic group having at least one basic nitrogen atom in its ring.

(6) The silver halide light-sensitive material described in item (1) above, containing 0.1 to 5 g of the polymer represented by Formula (1) per 100 g of dry gelatin of the silver halide emulsion layer.

(7) The silver halide light-sensitive material described in item (1) above, wherein tabular grains having an aspect ratio of 5 or more occupy 50% or more of the total projected area of the silver halide grains contained in the emulsion layer.

(8) The silver halide light-sensitive material described in item (1) above, wherein 60% (number) or more of the light-sensitive silver halide grains contain 10 or more dislocation lines per grain.

(9) The silver halide light-sensitive material described in item (1) above, wherein the light-sensitive silver halide grains contained in the emulsion is subjected to both selenium sensitization and sulfur sensitization.

(10) The silver halide light-sensitive material described in item (9) above, wherein the light-sensitive silver halide grains contained in the emulsion is chemically sensitized in the presence of cyanine spectral sensitizing dyes.

(11) The silver halide light-sensitive material described in item (1) above, having at least one silver halide emulsion layer on a support, the silver halide emulsion layer containing a silver halide emulsion, in which tabular grains having an aspect ratio of 2 or more occupy 50% or more of a total projected area of silver halide grains, and 0.1 to 5 g of a polymer represented by Formula (1) per 100 g of dry gelatin contained in the emulsion has been added after formation of the tabular grains and before completion of chemical sensitization.

(12) The silver halide light-sensitive material described in item (1) above, wherein tabular grains having an aspect ratio of 8 or more occupy 50% or more of the total projected area of a silver halide contained in the emulsion layer.

(13) The silver halide light-sensitive material described in item (1) above, wherein a variation coefficient of silver iodide contents between tabular grains contained in the emulsion layer and having an aspect ratio of 8 or more is 20% or less.

(14) The silver halide light-sensitive material described in item (1) above, wherein tabular grains having an aspect ratio of 12 or more occupy 50% or more of the total projected area of a silver halide grains contained in the emulsion layer.

(15) The silver halide light-sensitive material described in item (5) above, wherein a polymer represented by Formula (2) contains 1 to 15% (percentage by weight) of a repeating unit derived from an ethylenic unsaturated monomer having an imidazole group on its side chain.

(16) The silver halide light-sensitive material described in item (15) above, wherein a polymer represented by Formula (2) contains 1 to 20% (percentage by weight) of a repeating unit derived from an ethylenic unsaturated monomer having a carboxylic acid or sulfonic acid group, or its salt, as an anionic group.

(17) The silver halide light-sensitive material described in item (16) above, wherein a polymer represented by Formula (2) contains 65 to 98% (percentage by weight) of a repeating unit derived from acrylamide, methacrylamide, and diacetoneacrylamide, in addition to the repeating unit derived from the ethylenic unsaturated monomer having an imidazole group on its side chain and the repeating unit derived from the ethylenic unsaturated group having an anionic group.

DETAILED DESCRIPTION OF THE INVENTION

The present invention will be described in detail below.

A polymer containing a repeating unit having at least one basic nitrogen atom according to the present invention will be described below.

The polymer of the present invention contains a repeating unit having at least one basic nitrogen atom and is preferably soluble in neutral water, an acidic aqueous solution, or an alkaline aqueous solution. "Preferable solubility" means that the polymer is soluble in an amount of 0.1 wt % or more, more preferably 1 wt % or more, and most preferably 10 wt % or more in a medium.

A preferable example of the polymer of the present invention is the polymer represented by Formula (1) mentioned earlier.

In Formula (1), A represents a repeating unit derived from an ethylenic unsaturated monomer having at least one basic nitrogen atom, B represents a repeating unit, other than A, derived from an ethylenic unsaturated monomer, and each of x and y represents a percentage by weight. x represents 0.1 to 100, and y represents 0 to 99.9.

The details of Formulas (1) and (2) will be described below.

The basic nitrogen atom contained in the repeating unit represented by A is a nitrogen atom that can be protonated, or the protonated form of that nitrogen atom. A nitrogen atom with a quaternary ammonium structure cannot be protonated and is therefore not basic. Typically, a nitrogen atom of this type may be any of primary, secondary, and tertiary amino groups and may take the structure of ammonium salt neutralized with acid. The nitrogen atom may also take the form of a heterocyclic group having a primary, secondary, or tertiary amino group or the protonated form of any of these amino groups in its ring.

Examples of substituents for the secondary and tertiary amino groups are a substituted or nonsubstituted alkyl group (e.g., methyl, ethyl, n-propyl, n-butyl, n-octyl, benzyl, phenethyl, 2-methoxyethyl, 2-ethoxyethyl, 2-hydroxyethyl, and 2-hydroxypropyl) that has 1 to 20 carbon atoms, and a substituted or nonsubstituted aryl group (e.g., phenyl, naphthyl, 2-methylphenyl, 3-methylphenyl, 4-methoxyphenyl, 4-hydroxyphenyl, and 4-chlorophenyl) that has 6 to 20 carbon atoms.

Examples of the heterocyclic group containing the basic nitrogen atom in its ring are a substitutable, saturated or unsaturated heterocyclic ring (e.g., aziridine, pyrrolidine, piperidine, pyrrole, pyridine, indole, and quinoline) that contains only one nitrogen atom as a hetero atom, and a substitutable, saturated or unsaturated heterocyclic ring (e.g., imidazoline, imidazole, pyrazole, oxazole, thiazole, piperazine, triazole, tetrazole, oxadiazole, oxatriazole, dioxazole, pyrimidine, pyrimidazole, pyrazine, triazine, tetrazine, and benzimidazole) that has two or more hetero atoms selected from, e.g., a nitrogen atom, an oxygen atom, and a sulfur atom and contains at least one nitrogen atom.

Examples in the form of a monomer of the repeating unit represented by A in a polymer of Formula (1) of the present invention will be described below, but the present invention is not limited to these examples.

One example is a monomer having a heterocyclic group containing the basic nitrogen atom, such as vinylimidazole, 2-methyl-1-vinylimidazole, 4-vinylpyridine, 2-vinylpyridine, N-vinylcarbazole, 4-acrylamidopyridine, N-acryloylimidazole, N-2-acryloyloxyethylimidazole, 4-N-(2-acryloyloxyethyl-)aminopyridine, N-vinylbenzylimidazole, N-methacryloyloxyethylpyrrolidine, N-acryloylpiperazine, 1-vinyltriazole, 3,5-dimethyl-1-vinylpyrazole, N-methacryloyloxyethylmorpholine, N-vinylbenzylpiperidine, and N-vinylbenzylmorpholine.

Another example is a noncyclic monomer, such as
N,N-dimethylaminoethylmethacrylate,
N,N-diethylaminoethylmethacrylate,
N,N-diethylaminoethylacrylate,
N,N-dimethylaminopropylacrylamide,
N,N-diethylaminoethylacrylamide,
N,N-dimethylaminomethylstyrene, N,N-diethylaminomethylstyrene,
N,N-dibutylaminomethylstyrene,
N-methyl-N-vinylbenzylamine, N-vinylbenzylamine,
2-(2-methacryloyloxy)ethoxyaniline,
N-ethyl-N-vinylbenzylamine,
N-methyl-N-benzylaminoethylmethacrylate, and
(1-methyl-2-acrylamido)ethylamine.

Of these monomers, the monomer having a heterocyclic group containing the basic nitrogen atom in its ring is most preferable.

These monomers can be used either singly or in the form of a copolymer of two or more types of them in a polymer.

A preferable example of a copolymerizable ethylenic unsaturated monomer from which the repeating unit represented by B is derived is the one whose homopolymer is soluble in neutral water, an acidic aqueous solution, or an alkaline aqueous solution. Practical examples are a nonionic monomer, such as acrylamide, methacrylamide, N-methylacrylamide, N,N-dimethylacrylamide, N-acryloylmorpholine, N-ethylacrylamide, diacetoneacrylamide, N-vinylpyrrolidone, and N-vinylacetamide; a monomer having an anionic group, such as acrylic acid, methacrylic acid, itaconic acid, vinylbenzoic acid, styrenesulfonic acid, styrenesulfinic acid, phosphonoxyethylacrylate, phosphonoxyethylmethacrylate, 2-acrylamido-2-methylpropanesulfonic acid, 3-acrylamidopropionic acid, and 11-acrylamidoundecanoic acid, and its salt (e.g., sodium salt, potassium salt, and ammonium salt); and a monomer having a cationic group, such as N,N,N-trimethyl-N-vinylbenzylammoniumchloride and N,N,N-trimethyl-N-3-acrylamidopropylammoniumchloride.

The repeating unit of this type can contain a copolymer component that is rendered water-soluble by, e.g., hydrolysis. Examples are a repeating unit of vinyl alcohol (obtained by hydrolysis of a vinyl acetate unit) and a repeating unit of maleic acid (obtained by ring opening of anhydrous maleic acid).

Of these copolymer components, the repeating unit derived from a nonionic monomer or an anionic monomer is most preferable.

These ethylenic unsaturated monomers can be used either singly or in the form of a copolymer of two or more types of them if necessary.

The polymer of the present invention can also be copolymerized with another hydrophobic ethylenic unsaturated monomer so long as the water solubility of the polymer is impaired. Examples of such a monomer are ethylene, propylene, 1-butene, isobutene, styrene, α-methylstyrene, methylvinylketone, a monoethylenic unsaturated ester of aliphatic acid (e.g., vinyl acetate and allyl acetate), an ester of an ethylenic unsaturated monocarboxylic acid or dicarboxylic acid (e.g., methylmethacrylate, ethylmethacrylate, n-butylmethacrylate, n-hexylmethacrylate, 2-ethylhexylmethacrylate, cyclohexylmethacrylate, benzylmethacrylate, methylacrylate, ethylacrylate, n-butylacrylate, 2-hydroxyethylmethacrylate, 2-methoxyethylmethacrylate, 2-methanesulfonamidoethylmethacrylate, and monomethyl maleate), an ethylenic unsaturated amide of monocarboxylic acid (e.g., t-butylacrylamide, t-octylacrylamide, and 3-methoxypropylmethacrylamide), a monoethylenic unsaturated compound (e.g., acrylonitrile and methacrylonitrile), dienes (e.g., butadiene and isoprene).

x and y each represent the percentage by weight of each copolymer component. Although x and y change in accordance with, e.g., the structure of a monomer and the intended use, x is 0.1 to 100, preferably 1 to 50, and most preferably 1 to 30, and y is 0 to 99.9, preferably 50 to 99, and most preferably 70 to 99. x and y satisfy the relation that $x+y=100$.

The polymer of the present invention can be manufactured by various polymerization methods, such as solution polymerization, precipitation polymerization, suspension polymerization, bulk polymerization, and emulsion polymerization. In addition, a method of starting the polymerization can be any of, e.g., a method of using a free-radical initiator, a method of radiating light or rays, and a thermal polymerization method. These polymerization methods and methods of starting polymerization are described in, e.g., Sadaji Tsuruta, "High Polymer Synthesis Reaction," a revised edition (Nikkan Kogyo Shinbunsha, 1971); and Takayuki Otsu and Masanobu Kinoshita, "Method of High Polymer Synthesis Experiment," Kagaku Dojin, 1972, pages 124 to 154.

Among the above polymerization methods, the solution polymerization method using a free-radical initiator is most preferable. Examples of a solvent for use in the solution polymerization are water and a variety of organic solvents, such as ethyl acetate, methanol, ethanol, 1-propanol, 2-propanol, acetone, dioxane, N,N-dimethylformamide, N,N-dimethylacetamide, toluene, n-hexane, and acetonitrile. These organic solvents can be used either singly or in the form of a mixture of two or more types of them. These organic solvents can also be used in the form of a solvent mixture with water. Of these solvents, water or a mixture of water and an organic solvent miscible with water is most preferable for the polymer of the present invention.

The polymerization temperature must be set in accordance with the molecular weight of a polymer to be produced or the type of an initiator. Although a temperature of 0° C. or less to 100° C. or more is possible, polymerization is commonly performed at a temperature of 30° C. to 100° C.

Examples of the free-radical initiator for use in polymerization are an azo-based initiator, such as 2,2'-azobisisobutyronitrile, 2,2'-azobis(2,4-dimethylvaleronitrile), 2,2'-azobis(2-amidinopropane)dihydrochloride, and 4,4'-azobis(4-cyanopentanoicacid), and a peroxide-based initiator, such as benzoylperoxide, t-butylhydroperoxide, and potassium persulfate (also usable as a redox initiator in combination with, e.g., sodium hydrosulfite).

Although an amount of the initiator can be controlled in accordance with the polymerizability of each monomer or the molecular weight of a polymer required, it is preferably 0.01 to 10 mole %, and most preferably 0.01 to 2.0 mole % with respect to the monomer.

To synthesize the polymer of the present invention in the form of a copolymer, polymerization may be performed by placing the total amount of monomers to be used in a reactor vessel beforehand and then supplying an initiator. However, it is more preferable to perform synthesis through a process of dropping monomers into a polymerization medium.

In this case, two or more types of ethylenic unsaturated monomers to be used may be dropped either in the form of a mixture or independently of each other. In this dropping, the ethylenic unsaturated monomers may be dissolved in an appropriate co-solvent. Examples of the co-solvent are water, an organic solvent (such as those described above), and a solvent mixture of water and the organic solvent.

Although the dropping time depends on, e.g., the polymerization reaction activity of each ethylenic unsaturated monomer or the polymerization temperature, it is preferably 5 minutes to 8 hours, and most preferably 30 minutes to 4 hours. The dropping rate can be either equal throughout the dropping or varied properly within the dropping time. When ethylenic unsaturated monomers are to be dropped independently of each other, the total dropping time or the dropping rate of each monomer can be freely changed as needed. In particular, if the difference in polymerization reactivity between the ethylenic unsaturated monomers is large, it is preferable that, for example, a monomer having a higher reactivity be dropped more slowly.

The polymerization initiator can be added to a polymerization solvent in advance or can be added simultaneously with the addition of ethylenic unsaturated monomers. The polymerization initiator can also be dissolved in a solvent and dropped in the form of a solution independently of ethylenic unsaturated monomers. Alternatively, two or more types of these addition methods can be combined.

The polymer of the present invention can be synthesized by the above polymerization reaction by using the ethylenic unsaturated monomer having the basic nitrogen atom from which the repeating unit represented by A is derived and another ethylenic unsaturated monomer from which the repeating unit represented by B is derived. The polymer can also be synthesized by reacting a compound having the basic nitrogen atom with a polymer having a functional group (e.g., —OH, —COOH, —$NH_2$, —NHR, —SH, and an active halogen).

Examples of the compound that has the basic nitrogen atom and can be effectively bonded to the polymer chain are those having functional groups, such as —OH, —COOH, —$NH_2$, and —NHR. Practical examples are piperidine, morpholine, imidazole, 1,2,4-triazole, pyrazole, N-hydroxymorpholine, N-hydroxyethylpiperidine, 4-aminopyridine, 2-hydroxyethylimidazole, N-(3-aminopropyl)imidazole, 4-aminomethylpyrrolidine, N-hydroxyethylpyrrolidine, 2-hydroxybenzimidazole, dimethylamine, diethylamine, dibutylamine, ethylamine, n-butylamine, N-(2-aminoethyl)piperazine, N-(2-aminoethyl)-N,N-dimethylamine, N-(3-aminopropyl)-N,N-dimethylamine, N-(2-aminoethyl)-N,N-dibutylamine, N-(2-aminopropyl)-N,N-diethylamine, 4-dimethylaminophenol, and 3-dimethylaminobutanoicacid.

In the present invention, compounds that can be most effectively joined to a polymer chain are imidazoles.

These polymer and basic nitrogen atom-containing compound can be reacted directly or combined via, e.g., diisocyanate, diol, dicarboxylic acid, or diepoxide.

A polymer represented by Formula (2) preferably contains 1 to 15% (percentage by weight) of a repeating unit derived from an ethylenic unsaturated monomer having an imidazole group, such as vinylimidazole, on its side chain. If the content is less than 1%, the addition amount required to achieve the effect of the present invention is increased, and this may impair the compatibility with gelatin. If the content exceeds 15%, the effect of the present invention tends to remain on the same level or decrease.

A polymer represented by Formula (2) preferably contains 1 to 20% (percentage by weight) of a repeating unit derived from an ethylenic unsaturated monomer having a carboxylic acid or sulfonic acid group or its salt as an anionic group. The effect of the present invention is insignificant if the content is either less than 1% or more than 20%.

A polymer represented by Formula (2) preferably contains 65 to 98% (percentage by weight) of a repeating unit derived from acrylamide, methacrylamide, and diacetoneacrylamide in addition to the repeating unit derived from the ethylenic unsaturated monomer having an imidazole group on its side chain and the repeating unit derived from the ethylenic unsaturated monomer having the anionic group. A content falling outside this range degrades the compatibility with gelatin or the effect of the present invention.

Practical examples of polymers containing a repeating unit having the basic nitrogen atom represented by Formulas (1) and (2) of the present invention will be presented below, but the present invention is not limited to these examples. The numbers given in parentheses represent the percentage by weight ratio between individual copolymer components.

P-1 Acrylamide/soda acrylate/vinylimidazole/diacetone acrylamide copolymer (50/5/3/42)

P-2 Acrylamide/soda acrylate/vinylimidazole/diacetone acrylamide copolymer (42/7/8/43)

P-3 Acrylamide/soda acrylate/vinylimidazole/diacetone acrylamide copolymer (37/5/15/43)

P-4 Acrylamide/acrylic acid/vinylimidazole hydrochloride/diacetone acrylamide copolymer (22/5/30/43)

P-5 Acrylamide/soda acrylate/vinylimidazole copolymer (90/7/3)

P-6 Acrylamide/soda acrylate/vinylimidazole copolymer (83/7/10)

P-7 Acrylamide/vinylimidazole copolymer (90/10)

P-8 Methacrylamide/vinylimidazole copolymer (90/10)

P-9 N,N-dimethylacrylamide/vinylimidazole copolymer (92/8)

P-10 Acrylamide/soda styrenesulfonate/vinylimidazole copolymer (80/10/10)

P-11 Methylmethacrylate/soda 2-acrylamido-2-methylpropanesulfonate/vinylimidazole copolymer (15/75/10)

P-12 Styrene/acrylamide/soda 2-acrylamido-2-methylpropanesulfonate/vinylimidazole copolymer (10/40/40/10)

P-13 Acrylamide/soda methacrylate/2-methyl-1-vinylimidazole/diacetoneacrylamide copolymer (45/5/10/40)

P-14 Acrylamide/2-methyl-1-vinylimidazole copolymer (85/15)

P-15 Acrylamide/soda acrylate/2-vinylpyridine copolymer (80/5/15)

P-16 Acrylamide/soda acrylate/diacetoneacrylamide/2-methyl-1-vinylimidazole copolymer (38/22/30/10)

P-17 Acrylamide/4-vinylpyridine copolymer (90/10)

P-18 Acrylamide/diacetoneacrylamide/4-vinylpyridine copolymer (50/40/10)

P-19 Acrylamide/soda acrylate/diacetoneacrylamide/4-vinylpyridine copolymer (50/9/34/7)

P-20 Acrylamide/1-acryloyloxyethylimidazole copolymer (80/20)

P-21 Acrylamide/N-vinylpyrrolidone/1-acryloyloxyethyl imidazole copolymer (85/5/10)

P-22 Acrylamide/diacetoneacrylamide/N-vinylbenzyl imidazole copolymer (50/40/10)

P-23 Soda 2-acrylamide-2-methylpropanesulfonate/3-thiapentylacrylate/vinylimidazole copolymer (87/3/10)

P-24 Acrylamide/vinylimidazole/N-vinylbenzylpiperidine copolymer (90/5/5)

P-25 Methylacrylate/acrylamide/soda acrylate/vinyl imidazole/1-acryloyloxyethyltriazole copolymer (15/57/15/10/3)

P-26 Acrylamide/soda acrylate/N,N-dimethylaminoethyl methacrylate/diacetoneacrylamide copolymer (30/5/50/15)

P-27 Acrylamide/soda acrylate/vinylimidazole/-dimethyl aminomethylstyrene copolymer (75/12/8/5)

P-28 Acrylamide/N-(2-amino-2-methylpropyl)methacryl amide copolymer (90/10)

P-29 N,N-dimethylaminopropylacrylamide/potassium acrylate/diacetoneacrylamide copolymer (25/15/60)

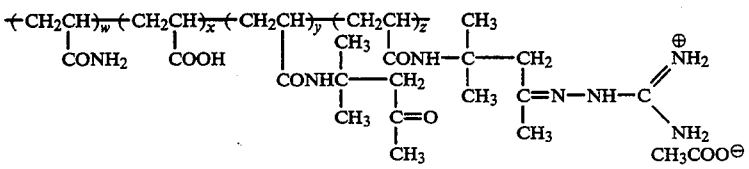

P-30 w/x/y/z = 60/5/10/25 (weight ratio)

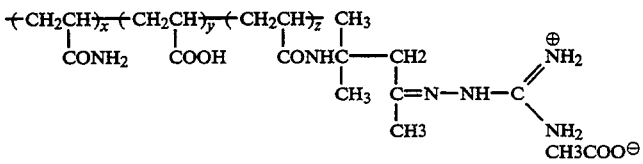

P-31 x/y/z = 15/15/70 (weight ratio)

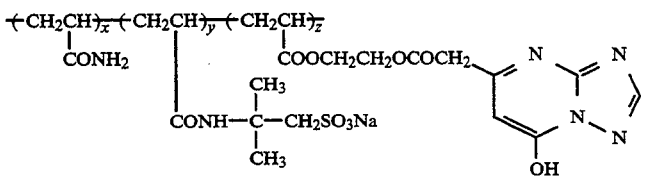

P-32 x/y/z = 40/27/33 (weight ratio)

Synthesis examples of the polymer of the present invention will be described below.

SYNTHESIS EXAMPLE (SYNTHESIS OF POLYMER P-2)

910 g of distilled water were placed in a 2-l three neck distillation flask, to which a stirrer, a reflux condenser, and a thermometer were attached, and stirred at a temperature of 70° C. under a nitrogen flow. Immediately after a solution prepared by dissolving 0.45 g of potassium persulfate into 65 g of distilled water was added to the water, a solution mixture of 140.6 g of acrylamide, 28.5 g of vinylimidazole, 16.6 g of acrylic acid, 139.5 g of diacetoneacrylamide, 55.9 g of isopropylalcohol, 250.5 g of distilled water, and 9.46 g of sodium hydroxide was dropped into the resultant solution at a constant rate over one hour. After the resultant solution mixture was stirred at 70° C. for one hour after the dropping, the internal temperature was raised to 90° C., and the solution was further stirred at that temperature for four hours.

The resultant solution was cooled and added with 1 l of methanol to prepare a polymer solution. The resultant polymer solution was poured into acetone, and precipitation and decantation were repeatedly performed. The resultant precipitate was filtered out and dried to obtain 325.8 g of the polymer P-2 of interest (yield 98%).

It is possible to arbitrarily use two or more types of the polymers of the present invention described above.

A preferable range of the molecular weight or the degree of polymerization of the polymer of the present invention varies depending on the type or the properties of an emulsion to which the polymer is applied or the structure of the polymer. However, the range is preferably 5,000 to 1,000,000, and most preferably 10,000 to 500,000.

Polymers represented by Formulas (1) and (2) of the present invention can be added at any point during the process of manufacturing emulsions: e.g., grain formation, desalting/washing, redispersion, chemical sensitization, and preparation of emulsions for coating. The polymers are preferably added before completion of chemical sensitization, and most preferably after grain formation and before completion of chemical sensitization.

Polymers represented by Formulas (1) and (2) of the present invention can be either added directly in the form of powders or dissolved in neutral water, an acidic aqueous solution, or an alkaline aqueous solution and added in the form of a solution.

In the present invention, it is preferable that a polymer represented by Formula (1) be contained in an amount of 0.1 to 5 g, more preferably 0.3 to 3 g per 100 g of dry gelatin in the silver halide emulsion layer. The polymer is contained in an amount of $10^{-3}$ to 10 g, preferably $10^{-1}$ to 3 g per mole of a silver halide emulsion.

It was totally unexpected that the deterioration with time of a silver halide emulsion in the form of a solution can be improved by using the polymers of the present invention together with a predetermined amount of gelatin.

In the emulsion of the present invention, tabular grains having an aspect ratio of 2 or more occupy 50% or more of the total projected area of all silver halide grains.

The "tabular grain" is a general term of grains having one twin plane or two or more parallel twin planes. The twin plane is a (111) plane on both sides of which all ions at lattice points have a mirror image relationship to each other. When this tabular grain is viewed from the above, it looks like a triangle, a hexagon, or a circular triangle or hexagon. The triangular, hexagonal, and circular grains have parallel triangular, hexagonal, and circular outer surfaces, respectively.

In the present invention, the aspect ratio of a tabular grain is the value obtained by dividing the grain diameter of a tabular grain having that of 0.1 μm or more by the thickness of that grain. The thickness of a grain can be easily measured by depositing a metal together with a latex as a reference obliquely on a grain, measuring the length of the shadow of the latex in an electron micrograph, and calculating by referring to the length of the shadow of the latex.

In the present invention, the grain size is the diameter of a circle having an area equal to the projected area of parallel outer surfaces of a grain.

The projected area of a grain can be obtained by measuring the area in an electron micrograph and correcting the photographing magnification.

The diameter of the tabular grain is preferably 0.15 to 5.0 μm, and its thickness is preferably 0.05 to 1.0 μm.

In the emulsion of the present invention, it is preferable that tabular grains having an aspect ratio of 3 or more, and more preferably 5 or more occupy 50% or more of the total projected area of all silver halide grains. In the present invention, the aspect ratio of tabular grains is particularly preferably 8 or more, and most preferably 12 or more.

The ratio of tabular grains is preferably 60% or more, and most preferably 80% or more of the total projected area.

It is sometimes possible to obtain more preferable effects by using monodisperse tabular grains. Although the structure and the method of manufacturing monodisperse tabular grains are described in, e.g., JP-A-63-151618 ("JP-A" means Published Unexamined Japanese Patent Application), the characteristics of the grains will be briefly described below. That is, a hexagonal tabular silver halide, in which the ratio of an edge having the maximum length with respect to the length of an edge having the minimum length is 2 or less, and which has two parallel faces as outer surfaces, accounts for 70% or more of the total projected area of silver halide grains. In addition, the grains have monodispersibility; that is, a variation coefficient of a grain size distribution of these hexagonal tabular silver halide grains (i.e., a value obtained by dividing a variation (standard deviation) in grain sizes, which are represented by equivalent-circle diameters of projected areas of the grains, by their average grain size) is 20% or less.

The method preferable in the present invention is to form tabular grains having a high monodispersibility and a high aspect ratio at any temperature that can be easily used in practice; the time required for nucleation being derived from the function of a temperature. When an aqueous silver nitrate solution and an aqueous potassium bromide solution are added to a reaction solution, precipitation of a silver halide occurs immediately. Although the number of the fine silver halide grains produced increases while silver ion and bromide ion are added, it does not increase in proportion to the time. That is, the increase in number becomes moderate gradually, and the number finally becomes a constant value. The silver halide grains produced by the precipitation starts growing immediately after the production. Nuclei produced earlier grow more easily; those produced later are more hard to grow. If a variation occurs in size of nuclei in growth during the nucleation, this variation is further increased in the subsequent Ostwald ripening. The extent of the size distribution of nuclei occurring in the nucleation is determined by the nucleation time and the temperature of a reaction solution. The extension of the size distribution starts when 60 seconds elapse, for nucleation performed at 30° C. This polydispersion starts when 30 seconds elapse, for nucleation performed at 70° C., and 15 seconds elapse, for nucleation performed at 75° C. A time before the start of this extension of the size distribution depends on the temperature during nucleation because this time reflects the time required for fine silver halide grains to dissolve. Completing nucleation within this time interval makes it possible to form tabular grains with a high aspect ratio at any temperature that is practically, easily usable, without impairing the monodispersibility.

Known examples of a method of nucleation are a so-called single-jet method, in which only an aqueous silver nitrate solution is added to a halide salt solution, and a double-jet method, in which an aqueous silver nitrate solution and an aqueous halide salt solution are added simultaneously. Preferable nucleation conditions of the present invention require a high generation probability of twinned crystal nuclei. Therefore, the double-jet method, in which these nuclei are easy to generate because of a high degree of super-saturation in a stirring/mixing device, is more preferable.

Although the nucleation can be performed between 20° C. and 60° C., it is preferably performed between 30° C. 60° C. in terms of suitability for manufacture, such as a high generation probability of twinned crystal nuclei. After the nucleation, the temperature is raised, the pAg is controlled to 7.6 to 10.0, and physical ripening is performed to eliminate grains other than tabular grains. After tabular grains alone are thus obtained, desired tabular seed crystal grains are formed through a process of grain growth. In the grain growth process, it is desirable to add silver and a halogen solution with care that no new crystal nuclei are generated. The aspect ratio of emulsion grains can be controlled by selecting the temperature and the pAg of the grain growth process and the addition rates of an aqueous silver nitrate solution and an aqueous halide solution to be added.

In addition, as described in JP-A-62-99751, a portion or all of silver to be added in the grain growth process can be supplied in the form of fine silver halide grains.

The emulsion of the present invention preferably has dislocations. Dislocations in tabular grains can be observed by a direct method performed at a low temperature using a transmission electron microscope, as described in, for example, J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to electron rays. In this case, as the thickness of a grain is increased, it becomes more difficult to transmit electron rays through it. Therefore, grains can be observed more clearly by using an electron microscope of a high voltage type (200 kV or more for a grain having a thickness of 0.25 μm). From photographs of grains obtained by the above method, it is possible to obtain the positions and the number of dislocations in each grain viewed in a direction perpendicular to the major faces of the grain.

It is preferable in the present invention that 60% (number) or more of the silver halide grains contain dislocations. More specifically, grains having preferably 10 dislocation lines, more preferably 20 dislocation lines, and most preferably 30 dislocation lines occupy 60% (number) or more. If dislocation lines are densely present or cross each other, it is sometimes impossible to correctly count dislocation lines per grain. In these situations, however, dislocation lines can be roughly counted to such an extent as in units of 10 lines.

Dislocation lines can be introduced to, e.g., a portion near the peripheral region of a tabular grain. In this case, dislocations are substantially perpendicular to the peripheral region and produced from a position x % of the length between the center and the edge (peripheral region) of a tabular grain to the peripheral region. The value of x is preferably 10 to less than 100, more preferably 30 to less than 99, and most preferably 50 to less than 98. In this case, although a shape obtained by connecting the start positions of the dislocations is almost similar to the shape of the grain, it is not perfectly similar but sometimes distorted. Dislocations of this type are not found in the central region of a grain. The direction of dislocation lines is crystallographically, approximately a (211) direction. Dislocation lines, however, is often zigzagged or sometimes cross each other.

A tabular grain may have dislocation lines either almost uniformly across the whole peripheral region or at a local position on the peripheral region. That is, in the case of a hexagonal tabular silver halide grain, dislocation lines may be limited to either portions near the six corners or only a portion near one of the six corners. In contrast, it is also possible to limit dislocation lines to only portions near the edges except for the portions near the six corners.

Dislocation lines can also be formed across a region containing the centers of two parallel major faces of a tabular grain. When dislocation lines are formed across the entire region of the major faces, the direction of the dislocation lines is sometimes crystallographically, approximately a (211) direction when observing in a direction perpendicular to the major faces. In some cases, however, the direction is a (110) direction or random. The lengths of the individual dislocation lines are also random; the dislocation lines are sometimes observed as short lines on the major faces and sometimes observed as long lines reaching the edges (peripheral region). Although dislocation lines are sometimes straight, they are often zigzagged. In many cases, dislocation lines cross each other.

As described above, the position of dislocations may be either limited to a local position on the peripheral region or on the major faces or formed on both of them. That is, dislocation lines may be present on both the peripheral region and the major faces.

Introducing dislocation lines to the peripheral region of a tabular grain can be achieved by forming a specific silver iodide rich layer inside the grain. The silver iodide rich layer includes a discontinuous silver iodide rich region. More specifically, after a substrate grain is prepared, the silver iodide rich layer is formed and covered with a layer having a silver iodide content lower than that of the silver iodide rich layer. The silver iodide content of the substrate tabular grain is lower than that of the silver iodide rich layer, preferably 0 to 20 mole %, and more preferably 0 to 15 mole %.

The silver iodide rich layer inside a grain means a silver halide solid solution containing silver iodide. This silver halide is preferably silver iodide, silver bromoiodide, or silver bromochloroiodide, and more preferably silver iodide or silver bromoiodide (silver iodide content 10 to 40 mole %). The silver iodide rich layer inside a grain (to be referred to as an internal silver iodide rich layer hereinafter) can be selectively formed on either the edge or the corner of a substrate grain by controlling the formation conditions of the substrate grain and the formation conditions of the internal silver iodide rich layer. Important factors as the formation conditions of a substrate grain are the pAg (the logarithm of the reciprocal of a silver ion concentration), the presence/absence, the type, and the amount of a silver halide solvent, and the temperature. By controlling the pAg to 8.5 or less, more preferably 8 or less during growth of substrate grains, the internal silver iodide rich layer can be selectively formed in portions near the corners of the substrate grain. On the other hand, by controlling the pAg to 8.5 or more, more preferably 9 or more during growth of substrate grains, the internal silver iodide rich layer can be formed on the edges of the substrate grain.

A variation coefficient of a silver iodide content distribution between tabular grains of the present invention is preferably 20% or less, more preferably 18% or less, and most preferably 15% or less. The effect of a small variation coefficient is significant especially in a tabular grain having a high aspect ratio such as a tabular grain having an aspect ratio of 8 or more.

The silver iodide content of individual emulsion grains can be measured by analyzing the composition of each grain by using an X-ray microanalyzer. The variation coefficient of the silver iodide content between grains can be calculated by measuring the silver iodide content of at least 100 emulsion grains. A method of measuring the silver iodide content of an emulsion grain is described in, e.g., EP 147,868A.

When a silver halide having silver iodide containing region is formed while iodide ions are rapidly being generated from an iodide ion-releasing agent represented by Formula (III), instead of performing the conventional method of adding free iodide ion, during epitaxial growth in the process of introducing dislocations, the present invention can achieve both introduction of dislocation lines at a high density and uniformly between grains and a narrow silver iodide content distribution in each grain, indicating the startling effect of the invention.

An iodide ion-releasing agent represented by Formula (III) of the present invention overlaps in part compounds used to obtain a uniform halogen composition in each silver halide grain and between individual grains in JP-A-2-68538 described above.

It is, however, totally unexpected for the present inventors to find that a silver halide emulsion having a low fog and a high sensitivity can be obtained by performing formation of silver halide grains while iodide ions are rapidly being generated from an iodide ion-releasing agent represented by Formula (III).

An iodide ion-releasing agent represented by Formula (III) below of the present invention will be described in detail.

Formula (III)

R—I wherein R represents a monovalent organic moiety which releases the iodine atom, I, in the form of iodide ions upon reacting with a base and/or a nucleophilic reagent.

The details of a compound represented by Formula (III) will be described. Preferable examples of R are an alkyl group having 1 to 30 carbon atoms, an alkenyl group having 2 to 30 carbon atoms, an alkinyl group having 2 or 3 carbon atoms, an aryl group having 6 to 30 carbon atoms, an aralkyl group having 7 to 30 carbon atoms, a heterocyclic group having 4 to 30 carbon atoms, an acyl group having 1 to 30 carbon atoms, a carbamoyl group, an alkyl or aryloxycarbonyl group having 2 to 30 carbon atoms, an alkyl or arylsulfonyl group having 1 to 30 carbon atoms, and a sulfamoyl group.

R is preferably one of the above groups having 20 or less carbon atoms, and most preferably one of the above groups having 12 or less carbon atoms.

It is also preferable that R be substituted, and examples of preferable substituents are as follows.

Examples are a halogen atom (e.g., fluorine, chlorine, bromine, and iodine), an alkyl group (e.g., methyl, ethyl, n-propyl, isopropyl, t-butyl, n-octyl, cyclopentyl, and cyclohexyl), an alkenyl group (e.g., allyl, 2-butenyl, and 3-pentenyl), an alkinyl group (e.g., propargyl and 3-pentynyl), an aralkyl group (e.g., benzyl and phenethyl), an aryl group (e.g., phenyl, naphthyl, and 4-methylphenyl), a heterocyclic group (e.g., pyridyl, furyl, imidazolyl, piperidyl, and morpholyl), an alkoxy group (e.g., methoxy, ethoxy, and butoxy), an aryloxy group (e.g., phenoxy and naphthoxy), an amino group (e.g., nonsubstituted amino, dimethylamino, ethylamino, and anilino), an acylamino group (e.g., acetylamino and benzoylamino), a ureido group (e.g., nonsubstituted ureido, N-methylureido, and N-phenylureido), a urethane group (e.g., methoxycarbonylamino and phenoxycarbonylamino), a sulfonylamino group (e.g., methylsulfonylamino and phenylsulfonylamino), a sulfamoylamino group (e.g., sulfamoyl, N-methylsulfamoyl, and N-phenylsulfamoyl), a carbamoyl group (e.g., carbamoyl, diethylcarbamoyl, and phenylcarbamoyl), a sulfonyl group (e.g., methylsulfonyl and benzenesulfonyl), a sulfinyl group (e.g., methylsulfinyl and phenylsulfinyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, and pivaloyl), an acyloxy group (e.g., acetoxy and benzoyloxy), a phosphoric amido group (e.g., N,N-diethyl phosphoric amido), an alkylthio group (e.g., methylthio and ethylthio), an arylthio group (e.g., a phenylthio group), a cyano group, a sulfo group, a carboxyl group, a hydroxy group, a phosphono group, and a nitro group.

A compound represented by Formula (III) of the present invention is preferably a compound represented by Formula (IV) or (V) below.

A compound represented by Formula (IV) of the present invention will be described below.

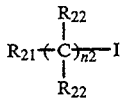

Formula (IV)

In Formula (IV), $R_{21}$ represents an electron-withdrawing group and $R_{22}$ represents a hydrogen atom or a substitutable group.

n2 represents an integer from 1 to 6. n2 is preferably an integer from 1 to 3, and most preferably 1 or 2.

The electron-withdrawing group represented by $R_{21}$ is preferably an organic group having a Hammett $\sigma_p$, $\sigma_m$, or $\sigma_I$ value larger than 0.

The Hammett $\sigma_p$ or $\sigma_m$ value is described in "Structural Activity Correlation of Chemicals" (Nanko Do), page 96 (1979), and the Hammett $\sigma_I$ value is described in the same literature, page 105. So the values can be selected on the basis of these tables.

Preferable examples of $R_{21}$ are a halogen atom (e.g., fluorine, chlorine, and bromine), a trichloromethyl group, a cyano group, a formyl group, a carboxylic acid group, a sulfonic acid group, a carbamoyl group (e.g., nonsubstituted carbamoyl and diethylcarbamoyl), an acyl group (e.g., an acetyl group and a benzoyl group), an oxycarbonyl group (e.g., methoxycarbonyl and ethoxycarbonyl), a sulfonyl group (e.g., methanesulfonyl and a benzenesulfonyl), a sulfonyloxy group (e.g., methanesulfonyl), a carbonyloxy group (e.g., acetoxy), a sulfamoyl group (e.g., non-substituted sulfamoyl and dimethylsulfamoyl), and a heterocyclic group (e.g., 2-thienyl, 2-benzoxazolyl, 2-benzothiazolyl, 1-methyl-2-benzimidazolyl, 1-tetrazolyl, and 2-quinolyl).

Examples of the substitutable group represented by $R_{22}$ are those enumerated above as the substituents for R.

It is preferable that one-half or more of a plurality of $R_{22}$'s contained in a compound represented by Formula (IV) be hydrogen atoms. A plurality of $R_{22}$'s present in a molecule may be the same or different.

$R_{21}$ and $R_{22}$ may be further substituted. Preferable examples of the substituents are those enumerated above as the substituents for R.

Also, $R_{21}$ and $R_{22}$ or two or more $R_{22}$'s may join together to form a 3- to 6-membered ring.

A compound represented by Formula (V) of the present invention will be described below.

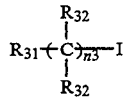

Formula (V)

In Formula (V), $R_{31}$ represents $R_{33}O$—, $R_{33}S$—, $(R_{33})_2N$—, $(R_{33})_2P$—, or phenyl, wherein $R_{33}$ represents a hydrogen atom, an alkyl group having 1 to 30 carbon atoms, an alkenyl group having 2 to 30 carbon atoms, an alkinyl group having 2 or 3 carbon atoms, an aryl group having 6 to 30 carbon atoms, an aralkyl group having 7 to 30 carbon atoms, or a heterocyclic group having 4 to 30 carbon atoms. If $R_{31}$ represents $(R_{33})_2N$— or $(R_{33})_2P$—, two $R_{33}$ groups may be the same or different.

$R_{32}$ and n3 have the same meanings as $R_{22}$ and n2 in Formula (IV), and a plurality of $R_{32}$'s may be the same or different.

Examples of the substitutable group represented by $R_{32}$ are those enumerated above as the substituents for R.

n3 is preferably 1, 2, 4, or 5.

$R_{31}$ and $R_{32}$ may be further substituted. Preferable examples of the substituents are those enumerated above as the substituents for R.

Also, $R_{31}$ and $R_{32}$, or two or more $R_{32}$'s may bond together to form a ring.

Practical examples of compounds represented by Formulas (III), (IV), and (V) of the present invention will be described below, but the present invention is not limited to these examples.

$ICH_2COOH$ (1)

$ICH_2CONH_2$ (2)

$ICH_2CN$ (3)

$I(CH_2)_2COOH$ (4)

$I(CH_2)_3COOH$ (5)

(6)

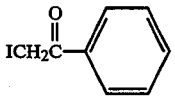

(7)

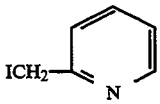

(8)

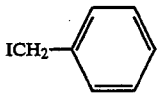

$I(CH_2)_2SO_3Na$ (9)

$I(CH_2)_2SO_2CH_3$ (10)

$I(CH_2)_2OH$ (11)

$I(CH_2)_3OH$ (12)

$I(CH_2)_4OH$ (13)

$ICH_2CHOH$ (14)
$\quad\quad |$
$\quad\quad CH_3$ $ICH_2CHOH$ (15)

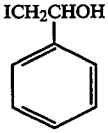

$ICH_2CHCH_2OH$ (16)
$\quad\quad |$
$\quad\quad OH$ $ICH_2CHCH_2SO_3Na$ (17)
$\quad\quad |$
$\quad\quad OH$ (18)

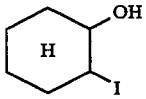

$ICH_2CHCHCH_2I$ (19)
$\quad\quad |\quad\quad |$
$\quad\quad OHOH$ (20)

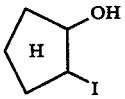

-continued $ICHCOOH$ (21)

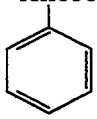

$I(CH_2)_2SO_2CH_2CONH_2$ (22)

$I(CH_2)_2NH_2$ (23)

$I(CH_2)_2NHSO_2CH_3$ (24)

$I(CH_2)_2NHCOCH_3$ (25)

$I(CH_2)_2OCH_3$ (26)

$I(CH_2)_2SCH_3$ (27)

(28)

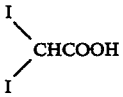

$ICH_2CHCH_2I$ (29)
$\quad\quad |$
$\quad\quad OH$ $I(CH_2)_2SO_2NH_2$ (30)

(31)

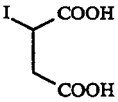

(32)

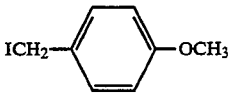

(33)

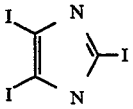

(34)

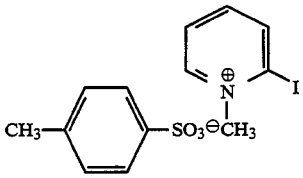

(35)

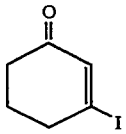

(36)

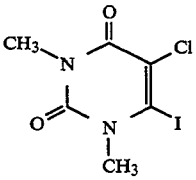

(37)

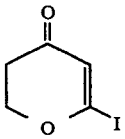

-continued
(38)
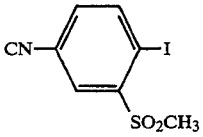
(39)
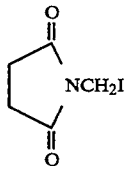
(40)
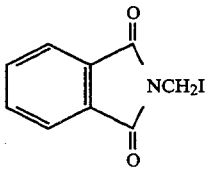
(41)
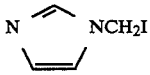
(42)
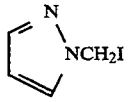
(43)
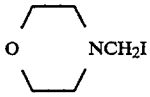
(44)
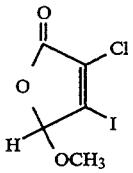
(45)
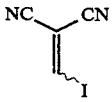
(46)
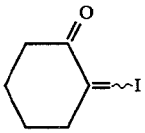
$I(CH_2)_5COOH$ (47)
(48)
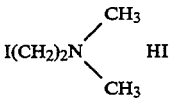
$I(CH_2)_2N(CH_3)SO_2CH_3$ (49)
$I(CH_2)_2OCOCH_3$ (50)
$I(CH_2)_2N(CH_3)COCH_3$ (51)
(52)
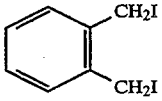
-continued
(53)
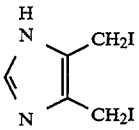
(54)
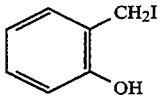
(55)
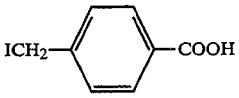
(56)
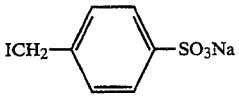
$ICH_2CONH(CH_2)_2—SO_3Na$ (57)
(58)
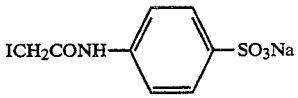
(59)
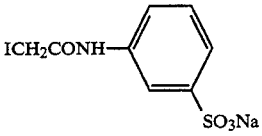
(60)
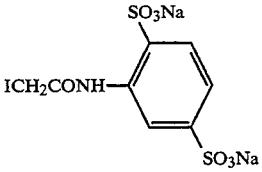
(61)
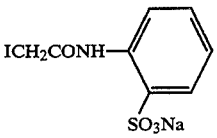
(62)
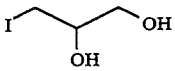
(63)
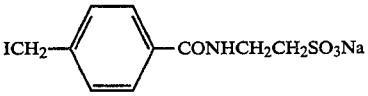
(64)
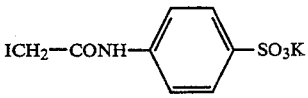
(65)
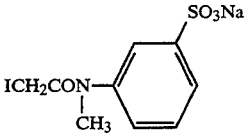

-continued (66)

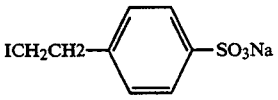

(67)

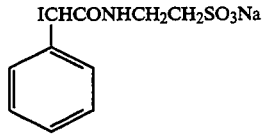

(68)

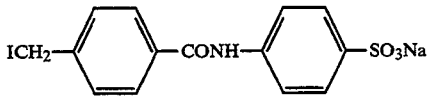

(69)

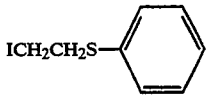

The iodide ion-releasing agent of the present invention can be synthesized in accordance with the following synthesizing methods:

J. Am. Chem. Soc., 76, 3227–8 (1954), J. Org. Chem., 16,798 (1951), Chem. Ber., 97, 390 (1964), Org. Synth., V, 478 (1973), J. Chem. Soc., 1951, 1851, J. Org. Chem., 19, 1571 (1954), J. Chem. Soc., 1952, 142, J. Chem. Soc., 1955, 1383, Angew, Chem., Int. Ed., 11, 229 (1972), Chem Commu., 1971, 1112.

The iodide ion-releasing agent of the present invention releases iodide ion upon reacting with an iodide ion release-controlling agent (a base and/or a nucleophilic reagent). Preferable examples of the nucleophilic reagent for this purpose are chemical species listed below:

Hydroxide ion, sulfurous acid ion, hydroxylamine, thiosulfuric acid ion, metabisulfurous acid ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines, and sulfides.

A preferable base is alkali hydroxide, such as KOH and NaOH, and a preferable nucleophilic reagent is $NaHSO_3$.

In the present invention, the rate and timing at which iodide ions are released can be controlled by controlling the concentration of the base or a nucleophilic reagent, the addition method, or the temperature of a reaction solution.

The range of concentration of the iodide ion-releasing agent and the iodide ion release-controlling agent for use in the rapid production of iodide ions is preferably $1\times10^{-6}$ to 20M, more preferably $1\times10^{-5}$ to 10M.

The range of temperature is preferably 30° to 80° C., and most preferably 35° to 75° C.

In the present invention, changes in pH of solution can be used if the base is used in releasing iodide ions.

In this case, the range of pH for controlling the rate and timing at which iodide ions are released may be controlled by controlling the range of pH to 2 to 12.

It is also possible to use the nucleophilic reagent and the base together. Here again, the rate and timing at which iodide ion is released may be controlled by controlling the pH within the above range.

The range of amount of iodide ions released from the iodide ion-releasing agent is preferably 1 to 10 mole %, and more preferably 1 to 8 mole % with respect to the total amount of the silver halides.

When iodine atoms are to be released in the form of iodide ion from the iodide ion-releasing agent, iodine atoms may be either released completely or partially left undecomposed.

The rate at which iodide ions are released from the iodide ion-releasing agent will be described in more detail below.

In the present invention, it is preferable to form a silver halide phase containing silver iodide on the edges of a tabular grain while iodide ions are rapidly being generated during the process of introducing dislocations into the tabular grain, in order to introduce dislocations at a high density.

If the time required to form a silver halide phase containing silver iodide on the edges is too long, the silver halide phase containing silver iodide dissolves again during the formation, and the dislocation density decreases.

What is important is that iodide ions be rapidly generated without causing any locality (nonuniform distribution).

When an iodide ion-releasing agent or an iodide ion release-controlling agent to be used together wherewith is added through an inlet to a reaction solution placed in a grain formation vessel, a locality with a high concentration of the added agent may be formed near the inlet. Thus, correspondingly, a locality of generated iodide ions is produced, since an iodide ion release reaction proceeds very quickly.

The rate at which iodide ion released is deposited on a host grain is very high, and grain growth occurs in a region near the addition inlet where the locality of the iodide ion is large. The result is grain growth nonuniform between individual grains.

Therefore, the iodide ion-releasing rate must be selected so as not to cause locality of iodide ions.

In conventional methods (e.g., a method of adding an aqueous potassium iodide solution), iodide ions are added in a free state even when an aqueous potassium iodide solution is diluted before the addition. This limits the reduction in locality of iodide ions. Therefore, it is difficult for the conventional methods to perform grain formation without causing nonuniformity between grains.

The present invention, however, which can control the iodide ion-releasing rate, makes it possible to reduce the locality of iodide ions compared to the conventional methods.

In the present invention, a preferable iodide ion-releasing rate is the one at which 100 to 50%, and more preferably 100 to 70% of the total weight of the iodide ion-releasing agent present in a reaction solution in a grain formation vessel complete release of iodide ion within 180 consecutive seconds. As described above, the iodide ion-releasing rate can be determined by controlling the temperature and the concentrations of the iodide ion-releasing agent and the iodide ion release-controlling agent.

When the reaction of rapidly producing iodide ions is represented by a second-order reaction essentially proportional to the concentration of the iodide ion-releasing agent and that of the iodide ion release-controlling agent (under water, 40° C.), the rate constant of the second-order reaction in the present invention is preferably $5\times10^{2}$ to $5\times10^{-3}$ ($M^{-1}.sec^{-1}$), more preferably $5\times10$ to $5\times10^{-2}$ ($M^{-1}.sec^{-1}$), and most preferably 10 to 1 ($M^{-1}.sec^{-1}$).

If the reaction is too fast, the reproducibility is impaired; if the reaction is too slow, required iodide ion becomes difficult to supply.

The following method is favorable to control the release of iodide ions in the present invention.

That is, this method allows the iodide ion-releasing agent, added to a reaction solution in a grain formation vessel and already distributed uniformly, to release iodide ion uniformly throughout the reaction solution by changing the pH, the concentration of a nucleophilic substance, and the temperature, normally by changing from a low pH to a high pH.

It is preferable that alkali for increasing the pH during release of iodide ions and the nucleophilic substance be added in a condition in which the iodide ion-releasing agent is distributed uniformly throughout the reaction solution.

Tabular grains used in the present invention are preferably subjected to selenium sensitization.

Selenium compounds disclosed in conventionally known patents can be used as a selenium sensitizer for use in the present invention. Normally, a labile selenium compound and/or a non-labile selenium compound is added to an emulsion, and the emulsion is stirred at high temperatures, preferably 40° C. or more for a predetermined time period. Preferable examples of the labile selenium compound are described in JP-B-44-15748, JP-B-43-13489, JP-A-4-25832, and JP-A-4-109240.

Practical examples of the labile selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro-2,6-dimethoxybenzoyl)selenide), selenophosphates, phosphineselenides, and colloidal metal selenium.

Although preferable examples of the labile selenium compound are described above, the present invention is not limited to these examples. It is generally agreed by those skilled in the art that the structure of a labile selenium compound used as a sensitizer for a photographic emulsion is not so important as long as selenium is labile, and that the organic part of a molecule of the selenium sensitizer has no important role except the role of carrying selenium and keeping it in a labile state in an emulsion. In the present invention, therefore, labile selenium compounds in this extensive concept are advantageously used.

Examples of the non-labile selenium compound used in the present invention are those described in JP-B-46-4553, JP-B-52-34492, and JP-B-52-34491. Specific examples of the non-labile selenium compound are selenious acid, potassium selenocyanide, selenazoles, quaternary salts of selenazoles, diarylselenide, diaryldiselenide, dialkylselenide, dialkyldiselenide, 2-selenazolidinedione, 2-selenoxazolidinethione, and derivatives of these compounds.

Among these selenium compounds, those preferably used in the present invention are compounds represented by Formulas (VI) and (VII) below.

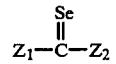

Formula (VI)

wherein $Z_1$ and $Z_2$ may be the same or different and each represent an alkyl group (e.g., methyl, ethyl, t-butyl, adamantyl, and t-octyl), an alkenyl group (e.g., vinyl and propenyl), an aralkyl group (e.g., benzyl and phenethyl), an aryl group (e.g., phenyl, pentafluorophenyl, 4-chlorophenyl, 3-nitrophenyl, 4-octylsulfamoylphenyl, and α-naphthyl), a heterocyclic group (e.g., pyridyl, thienyl, furyl, and imidazolyl), $—NR_1(R_2)$, $—OR_3$, or $—SR_4$.

$R_1$, $R_2$, $R_3$, and $R_4$ may be the same of different and each represent an alkyl group, an aralkyl group, an aryl group, or a heterocyclic group. Examples of the alkyl group, the aralkyl group, the aryl group, and the heterocyclic group can be the same as those enumerated above for $Z_1$. Note that $R_1$ and $R_2$ each can be a hydrogen atom or an acyl group (e.g., acetyl, propanoyl, benzoyl, heptafluorobutanoyl, difluoroacetyl, 4-nitrobenzoyl, α-naphthoyl, and 4-trifluoromethylbenzoyl).

In Formula (VI), $Z_1$ preferably represents an alkyl group, an aryl group, or $—NR_1(R_2)$ and $Z_2$ preferably represents $—NR_5(R_6)$ wherein $R_1$, $R_2$, $R_5$, and $R_6$ may be the same or different and each represents a hydrogen atom, an alkyl group, an aryl group, or an acyl group.

More preferable examples of a selenium compound represented by Formula (VI) are N,N-dialkylselenourea, N,N,N'-trialkyl-N'-acylselenourea, tetraalkylselenourea, N,N-dialkyl-arylselenoamide, and N-alkyl-N-aryl-arylselenoamide.

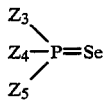

Formula (VIII)

wherein $Z_3$, $Z_4$, and $Z_5$ may be the same or different and each represents an aliphatic group, an aromatic group, a heterocyclic group, $—OR_7$, $—NR_8(R_9)$, $—SR_{10}$, $—SeR_{11}$, X, or a hydrogen atom.

$R_7$, $R_{10}$, and $R_{11}$ each represent an aliphatic group, an aromatic group, a heterocyclic group, a hydrogen atom, or a cation, and $R_8$ and $R_9$ each represent an aliphatic group, an aromatic group, a heterocyclic group, or a hydrogen atom. X represents a halogen atom.

In Formula (VII), an aliphatic group represented by $Z_3$, $Z_4$, $Z_5$, $R_7$, $R_8$, $R_9$, $R_{10}$, or $R_{11}$ represents a straight-chain, branched, or cyclic alkyl, alkenyl, alkinyl, or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, and phenethyl).

In Formula (VII), an aromatic group represented by $Z_3$, $Z_4$, $Z_5$, $R_7$, $R_8$, $R_9$, $R_{10}$, or $R_{11}$ represents a monocyclic or condensed-ring aryl group (e.g., phenyl, pentafluorophenyl, 4-chlorophenyl, 3-sulfophenyl, α-naphthyl, and 4-methylphenyl).

In Formula (VII), a heterocyclic group represented by $Z_3$, $Z_4$, $Z_5$, $R_7$, $R_8$, $R_9$, $R_{10}$, or $R_{11}$ represents a 3-to 10-membered saturated or unsaturated heterocyclic group (e.g., pyridyl, thienyl, furyl, thiazolyl, imidazolyl, and benzimidazolyl) containing at least one of a nitrogen atom, an oxygen atom, and a sulfur atom.

In Formula (VII), a cation represented by $R_7$, $R_{10}$, or $R_{11}$ represents an alkali metal atom or ammonium, and a halogen atom represented by X represents a fluorine atom, a chlorine atom, a bromine atom, or an iodine atom.

In Formula (VII), $Z_3$, $Z_4$, or $Z_5$ preferably represents an aliphatic group, an aromatic group, or $—OR_7$, and $R_7$ preferably represents an aliphatic group or an aromatic group.

More preferable examples of a compound represented by Formula (VII) are trialkylphosphineselenide, triarylphosphineselenide, trialkylselenophosphate, and triarylselenophosphate.

Practical examples of compounds represented by Formulas (VI) and (VII) are presented below, but the present invention is not limited to these examples.

1. 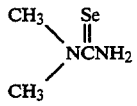

2. 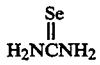

3. 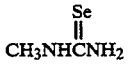

4. 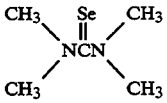

5. 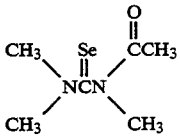

6. 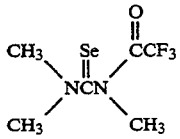

7. 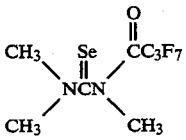

8. 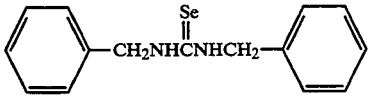

9. 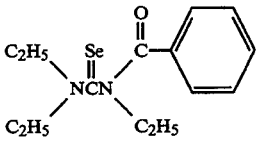

10. 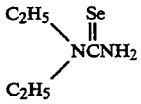

11. 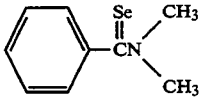

-continued

12. 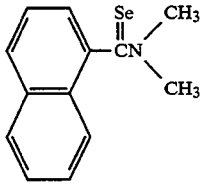

13. 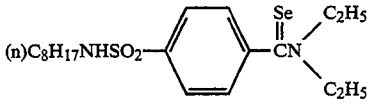

14. 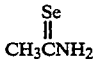

15. 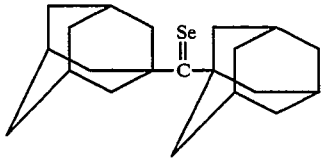

16. 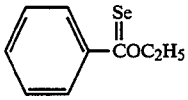

17. 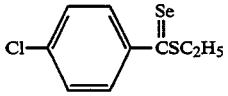

18. 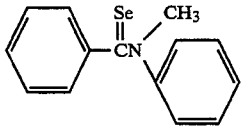

19. 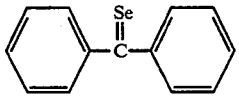

20. 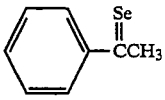

21. 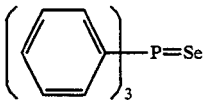

22. 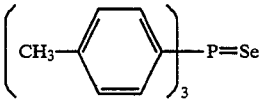

23. $(nC_4H_9)_3P{=}Se$

24. 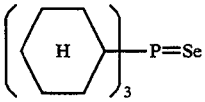

-continued

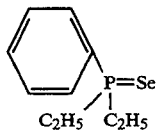

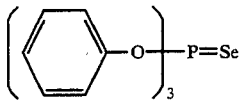

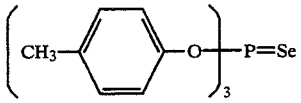

$(nC_4H_9O)_3P{=}Se$

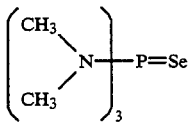

$(C_2H_5O)_3P{=}Se$

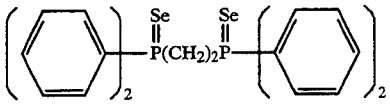

$(nC_8H_{17})_3P{=}Se$

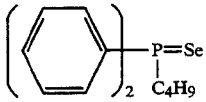

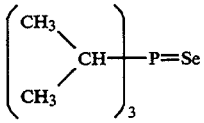

These selenium sensitizers are dissolved in water, an organic solvent, such as methanol or ethanol, or a solvent mixture of these organic solvents, and the resultant solution is added during chemical sensitization, preferably before start of chemical sensitization. A selenium sensitizer to be used is not limited to one type, but two or more types of the selenium sensitizers described above can be used together. A combination of the labile selenium compound and the non-labile selenium compound is preferable.

The addition amount of the selenium sensitizers used in the present invention changes in accordance with the activity of each selenium sensitizer used, the type or grain size of a silver halide, and the temperature and time of ripening. The addition amount, however, is preferably $1\times10^{-8}$ mole or more, and more preferably $1\times10^{-7}$ to $5\times10^{-5}$ mole per mole of a silver halide. When the selenium sensitizers are used, the temperature of chemical ripening is preferably 45° C. or more, and more preferably 50° C. to 80° C. The pAg and the pH can be arbitrarily set. For example, the effect of the present invention can be obtained by a pH over a wide range of 4 to 9.

The selenium sensitization can be performed more effectively in the presence of a silver halide solvent.

Examples of the silver halide solvent usable in the present invention are (a) organic thioethers described in, e.g., U.S. Pat. Nos. 3,271,157, 3,531,289, and 3,574,628, JP-A-54-1019, and JP-A-54-158917, (b) thiourea derivatives described in JP-A-53-82408, JP-A-55-77737, and JP-A-55-2982, (c) a silver halide solvent having a thiocarbonyl group sandwiched between an oxygen or sulfur atom and a nitrogen atom described in JP-A-53-144319, (d) imidazoles described in JP-A-54-100717, (e) sulfite, and (f) thiocyanate.

Most preferable examples of the silver halide solvent are thiocyanate and tetramethylthiourea. Although the amount of the solvent to be used changes in accordance with its type, a preferable amount of, e.g., thiocyanate is $1\times10^{-4}$ to $1\times10^{-2}$ mole per mole of a silver halide.

It is preferable that the silver halide emulsions of the present invention be also subjected to sulfur sensitization in addition to the selenium sensitization in the chemical sensitization.

The sulfur sensitization is normally performed by adding sulfur sensitizers to an emulsion and stirring the resultant emulsion at a high temperature of preferably 40° C. or more for a predetermined time.

Sulfur sensitizers known to those skilled in the art can be used in the sulfur sensitization. Examples of the sulfur sensitizer are thiosulfate, allylthiocarbamide, thiourea, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016. The addition amount of the sulfur sensitizer need only be the one that can effectively increase the sensitivity of an emulsion. Although this amount changes over a wide range in accordance with various conditions, such as a pH, a temperature, and the size of silver halide grains, it is preferably $1\times10^{-7}$ to $5\times10^{-5}$ mole per mole of a silver halide. Although the molar ratio of the sulfur sensitizers to the selenium sensitizers can be arbitrarily selected, it is desirable that the sulfur sensitizers be used in an equal molar quantity or more with respect to the selenium sensitizers.

The emulsions of the present invention are preferably subjected to gold sensitization in addition to the selenium sensitization or the selenium-sulfur sensitization in the chemical sensitization.

The gold sensitization is normally performed by adding gold sensitizers to an emulsion and stirring the emulsion at a high temperature, preferably 40° C. or more for a predetermined time.

The gold sensitizer for use in the gold sensitization can be any compound having an oxidation number of gold of +1 or +3, and it is possible to use gold compounds normally used as a gold sensitizer. Representative examples of the gold sensitizer are chloroaurate, potassium chloroaurate, auricrichloride, potassium auricthiocyanate, potassium iodoaurate, tetracyanoauric acid, ammonium aurothiacyanate, and pyridyltrichlorogold.

Although the addition amount of the gold sensitizer changes in accordance with various conditions, it is preferably $1\times10^{-7}$ and $5\times10^{-5}$ mole per mole of a silver halide.

In chemical ripening, it is not particularly necessary to limit the addition timings and the addition order of the silver halide solvent and the selenium, sulfur, and gold sensitizers. For example, the above compounds can be added simultaneously or at different addition timings in (preferably) the initial stage of or during the chemical ripening. The above compounds are dissolved in water, an organic solvent mixable with water, such as methanol, ethanol, or acetone, or a solvent mixture of these organic solvents, and the resultant solution is added to an emulsion.

A silver halide grain used in the present invention consists of silver bromide, silver chloride, silver iodide, silver chlorobromide, silver iodochloride, silver bromoiodide, or silver bromochloroiodide. A silver halide grain containing a large amount of silver chloride is preferable when it is desired that steps of development and desilvering (bleaching, fixing, and bleach-fixing) be rapidly performed. In order to suppress development to a proper extent, a silver halide grain preferably contains silver iodide. A preferable silver iodide content depends on a light-sensitive material of interest. For example, a preferable silver iodide content is 0.1 to 15 mole % for X-ray light-sensitive materials, and 0.1 to 5 mole % for graphic arts and micro light-sensitive materials. In the case of light-sensitive materials for photography represented by a color negative film, a silver halide contains preferably 1 to 30 mole %, more preferably 5 to 20 mole %, and most preferably 8 to 15 mole % of silver iodide. Adding silver chloride to a silver bromoiodide grain is preferable to reduce lattice distortion.

The silver halide emulsion of the present invention preferably has a distribution or a structure associated with a halogen composition in its grains. A typical example of such a grain is a core-shell or double structure grain having different halogen compositions in its interior and surface layer as disclosed in, e.g., JP-B-43-13162 ("JP-B" means Published Examined Japanese Patent Application), JP-A-61-215540, JP-A-60-222845, JP-A-60-143331, or JP-A-61-75337. The structure need not be a simple double structure but may be a triple structure or a multiple structure larger than the triple structure as disclosed in JP-A-60-222844. It is also possible to bond a thin silver halide having a different composition from that of a core-shell double-structure grain on the surface of the grain.

The structure to be formed inside a grain need not be the surrounding structure as described above but may be a so-called junctioned structure. Examples of the junctioned structure are disclosed in JP-A-59-133540, JP-A-58-108526, EP 199,290A2, JP-B-58-24772, and JP-A-59-16254. A crystal to be junctioned, which has a different composition from that of a host crystal, can be formed on the edge, the corner, or the face of the host crystal. Such a junctioned crystal can be formed regardless of whether a host crystal is uniform in halogen composition or has a core-shell structure.

In a silver halide grain in which two or more silver halides are present as a mixed crystal or with a structure, it is important to control the distribution of halogen compositions between grains. A method of measuring the distribution of halogen compositions between grains is described in JP-A-60-254032. A uniform halogen distribution between grains is a desirable characteristic. In particular, a highly uniform emulsion having a variation coefficient of 20% or less is preferable.

It is important to control the halogen composition near the surface of a grain. Increasing the silver iodide content or the silver chloride content near the surface can be selected in accordance with the intended use because this changes a dye adsorbing property or a developing rate. In order to change the halogen composition near the surface, it is possible to select either the structure in which a grain is entirely surrounded by a silver halide or the structure in which a silver halide is adhered to only a portion of a grain. For example, a halogen composition of only one of a (100) face and a (111) face of a tetradecahedral grain may be changed, or a halogen composition of one of a major face and a side face of a tabular grain may be changed.

In the present invention, it is possible to use a so-called polydisperse emulsion having a wide grain size distribution or a monodisperse emulsion having a narrow grain size distribution in accordance with the intended use. As a measure representing the size distribution, a variation coefficient of either the equivalent-circle diameter of the projected area of a grain or the equivalent-sphere diameter of the volume of a grain is sometimes used. When a monodisperse emulsion is to be used, it is desirable to use an emulsion having a size distribution with a variation coefficient of preferably 25% or less, more preferably 20% or less, and most preferably 15% or less.

In the preparation of an emulsion of the present invention, it is preferable to make salt of metal ion exist during grain formation, desalting, or chemical sensitization, or before coating in accordance with the intended use. The metal ion salt is preferably added during grain formation in performing doping for grains, and after grain formation and before completion of chemical sensitization in decorating the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in a combination of two or more types of them.

The metal compounds are preferably dissolved in an appropriate solvent, such as methanol or acetone, and added in the form of a solution. To stabilize the solution, an aqueous hydrogen halide solution (e.g., HCl and HBr) or an alkali halide (e.g., KCl, NaCl, Kbr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg atmosphere at pAg 1 to 7, and a method called high-pH ripening in which grains are grown or ripened in a high-pH atmosphere at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mole per mole of a silver halide.

The reduction sensitizers are dissolved in water or a solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced may form a silver salt hard to dissolve in water, such as a silver halide, silver sulfide, or silver selenide, or a silver salt easy to dissolve in water, such as silver nitrate. The oxidizer for silver may be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O)$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are an inorganic oxidizer such as ozone, hydrogen peroxide and its adduct, a halogen element, and thiosulfonate, and an organic oxidizer such as quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be selectively performed during grain formation or chemical sensitization.

Photographic emulsions used in the present invention may contain various compounds in order to prevent fog during the manufacturing process, storage, or photographic treatments of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7-)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect, and for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. The most preferable dye is a cyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei may be substituted on a carbon atom.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

Emulsions may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

It is most preferable to perform the chemical sensitization in the presence of sensitizing dyes, preferably, cyanine dyes.

The addition amount may be $4\times10^{-6}$ to $8\times10^{-3}$ mole per mole of a silver halide. However, for a more preferable silver halide grain size of 0.2 to 1.2 μm, an addition amount of about $5\times10^{-5}$ to $2\times10^{-3}$ mole is more effective.

Although the several different additives described above can be used in the light-sensitive material according to the present invention, a variety of other additives can also be used in accordance with the intended use.

The details of these additives are described in Research Disclosures Iten 17643 (December, 1978), Iten 18716 (November, 1979), and Iten 308119 (December, 1989), and these portions are summarized in a table below.

| Additives | RD17643 | RD18716 | RD308119 |
|---|---|---|---|
| 1. Chemical sensitizers | page 23 | page 648, right column | page 996 |
| 2. Sensitivity increasing agents | | page 648, right column | |
| 3. Spectral sensitizers, super sensitizers | pages 23–24 | page 648, right column to page 649, right column | page 996, right column to page 998, right column |
| 4. Brighteners | page 24 | | page 998, right column |
| 5. Antifoggants and stabilizers | pages 24–25 | page 649, right column | page 998, right column to page 1,000, right column |
| 6. Light absorbent, filter dye, ultraviolet absorbents | pages 25–26 | page 649, right column to page 650, left column | page 1,000, left column to page 1,003, right column |
| 7. Stain preventing agents | page 25, right column | page 650, left to right columns | page 1,002, right column |
| 8. Dye image stabilizer | page 25 | page 650, left column | page 1,002, right column |
| 9. Hardening agents | page 26 | page 651, left column | page 1,004, right column to page 1,005, left column |
| 10. Binder | page 26 | page 651, left column | page 1,003, right column to page 1,004, right column |
| 11. Plasticizers, lubricants | page 27 | page 650, right column | page 1,006, left to right columns |
| 12. Coating aids, surface active agents | pages 26–27 | page 650, right column | page 1,005, left column to page 1,006, left column |
| 13. Antistatic agents | page 27 | page 650, right column | page 1,006, right column to page 1,007, left column |
| 14. Matting agent | | | page 1,008, left column to page 1,009, left column |

The present invention can be applied to a color photographic light-sensitive material. In the light-sensitive material of the present invention, at least one of blue-, green-, and red-sensitive silver halide emulsion layers need only be formed on a support, and the number and order of the silver halide emulsion layers and non-light-sensitive layers are not particularly limited. A typical example is a silver halide photographic light-sensitive material having, on its support, at least one light-sensitive layer constituted by a plurality of silver halide emulsion layers which are sensitive to essentially the same color but have different sensitivities. This light-sensitive layer is a unit sensitive layer which is sensitive to one of blue light, green light, and red light. In a multilayered silver halide color photographic light-sensitive material, such unit light-sensitive layers are generally arranged in an order of red-, green-, and blue-sensitive layers from a support. However, according to the intended use, this arrangement order may be reversed, or light-sensitive layers sensitive to the same color may sandwich another light-sensitive layer sensitive to a different color.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity is sequentially decreased toward a support, and a non-light-sensitive layer may be formed between the respective silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-speed emulsion layer/high-speed emulsion layer/low-speed emulsion layer from the farthest side from a support in a layer sensitive to one color as described in JP-A-59-202464.

In addition, an order of high-speed emulsion layer/-low-speed emulsion layer/medium-speed emulsion layer or low-speed emulsion layer/medium-speed emulsion layer/high-speed emulsion layer may be adopted.

Furthermore, the arrangement can be changed as described above even when four or more layers are formed.

As described above, various layer arrangements and orders can be selectively used in accordance with the intended application of a light-sensitive material.

In the light-sensitive material of the present invention, it is possible to simultaneously use, in a single layer, two or more types of emulsions different in at least one of characteristics of a light-sensitive silver halide emulsion, i.e., a grain size, a grain size distribution, a halogen composition, a grain shape, and a sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in light-sensitive silver halide emulsion layers and/or essentially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852.

A silver halide which forms the core of an internally fogged core/shell type silver halide grain may have either a single halogen composition or different halogen compositions. As the internally fogged or surface-fogged silver halide, any of silver chloride, silver chlorobromide, silver bromoiodide, and silver bromochloroiodide can be used. Although the grain size of these fogged silver halide grains is not particularly limited, the average grain size is preferably 0.01 to 0.75 μm, and most preferably 0.05 to 0.6 μm. Since the grain shape is not particularly limited either, regular grains may be used. The emulsion may be a polydisperse emulsion but is preferably a monodisperse emulsion (in which at least 95% in weight or the number of grains of silver halide grains have grain sizes falling within a range of ±40% of an average grain size).

In the present invention, it is preferable to use a non-light-sensitive fine grain silver halide. The non-light-sensitive fine grain silver halide preferably consists of silver halide grains which are not exposed during imagewise exposure for obtaining a dye image and are not essentially developed during development. These silver halide grains are preferably not fogged in advance.

In the fine grain silver halide, the content of silver bromide is 0 to 100 mol%, and silver chloride and/or silver iodide may be added if necessary. The fine grain silver halide preferably contains 0.5 to 10 mol % of silver iodide.

The average grain size (average value of an equivalent-circle diameter of a projected area) of the fine grain silver halide is preferably 0.01 to 0.5 μm, and more preferably 0.02 to 2 μm.

The fine grain silver halide can be prepared following the same procedures as for a common light-sensitive silver halide. In this case, the surface of each silver halide grain need not be chemically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be preferably added to this fine grain silver halide grain-containing layer.

The silver coating amount of the light-sensitive material of the present invention is preferably 6.0 g/m$^2$ or less, and most preferably 4.5 g/m$^2$ or less.

In order to prevent deterioration in photographic properties caused by formaldehyde gas, the light-sensitive material is preferably added with a compound described in U.S. Pat. No. 4,411,987 or 4,435,503, which can react with formaldehyde to fix it.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains a compound described in JP-A-1-106052, which releases a fogging agent, a development accelerator, a silver halide solvent, or a precursor of any of them regardless of a developed amount of silver produced by development.

The light-sensitive material of the present invention preferably contains dyes dispersed by methods described in WO 04794/88 and PCT No. 1-502912, or dyes described in EP 317,308A, U.S. Pat. No. 4,420,555, and JP-A-1-259358.

Various color couplers can be used in the present invention, and specific examples of these couplers are described in patents described in above-mentioned Research Disclosure No. 17643, VII-C to VII-G and No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patent 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-3573, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027.

Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tertoctylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 seconds or less, and more preferably, 20 seconds or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness−film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline sulfate is preferred in particular.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene- 1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in West German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Further, the silver halide light-sensitive material of the present invention can be applied also to a heat-developing light-sensitive material as disclosed in, e.g., U.S. Pat. No. 4,500,626, JP-A-60-133449, JP-A-59-218443, JP-A-61-238056, and European Patent 210,660A2.

The silver halide color light-sensitive material of the present invention exerts its advantages more effectively when applied to a film unit equipped with a lens disclosed in JP-B-2-32615 or Examined Published Japanese Utility Model Application (JU-B) 3-39782.

The present invention will be described in more detail below by way of its examples, but the invention is not limited to these examples.

EXAMPLE 1

(1) Preparation of Emulsions 10 g of potassium bromide, 0.4 g of potassium iodide, and 15 g of inert gelatin having an average molecular weight of 15,000 were dissolved in 3.7 l of distilled water. While the resultant solution was stirred sufficiently, a 14% aqueous potassium bromide solution and a 20% aqueous silver nitrate solution were added to the solution by a double-jet method at constant flow rates over 15 seconds with the temperature and the pBr kept at 55° C. and 1.0, respectively (in this addition, 5.5% of the total silver amount were consumed).

An aqueous gelatin solution (17%, 300 cc) was added to the resultant solution, and the mixture was stirred at 55° C. Thereafter, a 20% aqueous silver nitrate solution was added to the resultant solution at a constant flow rate until the pBr reached 1.4 (in this addition, 5.0% of the total silver amount were consumed). In addition, a 20% potassium bromoiodide solution ($KBr_{1-x}I_x$: x=0.04) and a 33% aqueous silver nitrate solution were added to the resultant solution by the double-jet method over 43 minutes (in this addition, 25% of the total silver amount were consumed). After an aqueous solution containing 4.5 g of potassium iodide was added, 14.5 ml of a 0.001 wt % aqueous $K_3IrCl_6$ solution were added to the mixture, and an aqueous solution mixture containing 18% potassium bromide and 3% potassium iodide and a 33% aqueous silver nitrate solution were added to the resultant mixture by the double-jet method over 39 minutes (in this addition, 64.5% of the total silver amount were consumed). The silver nitrate amount used in this emulsion was 425 g. Subsequently, desalting was performed by a regular flocculation method. After the desalting, polymers of the present invention are added in the form of aqueous solutions in amounts listed in Table 2 in the process of causing redispersion by the addition of gelatin after the desalting. Thereafter, the pAg and the pH were controlled to 8.2 and 5.8, respectively, at a temperature of 40° C. The result was a tabular silver bromoiodide emulsion (Em-3) in which tabular grains having an aspect ratio of 5 or more occupied 50% of the total projected area and tabular grains having an aspect ratio of 2 or more occupied 90% of the total projected area (average aspect ratio 6.0). The emulsion (Em-3) was found to have a variation coefficient of 18% and an average diameter as sphere of 0.6 μm. When the emulsion was observed at the liquid $N_2$ temperature by a 200-kV transmission electron microscope, grains having 50 or more dislocation lines per grain occupied 60%.

By changing the growth condition (the pBr in growth in the double-jet method) and using a solvent (potassium thiocyanate) in the process of preparing Em-3, several different grains were prepared: potato-like grains (Em-1) in which tabular grains having an aspect ratio of 2 or more occupied 35% of the total projected area (average aspect ratio 1.5); tabular grains (Em-2) in which tabular grains having an aspect ratio of 2 or more occupied 65% of the total projected area (average aspect ratio 3.5); and tabular grains (Em-5) in which tabular grains having an aspect ratio of 5 or more occupied 85% of the total projected area (average aspect ratio 15.0). In addition, Em-4 was prepared by omitting the addition of the aqueous solution containing 4.5 g of potassium iodide from the process of preparing Em-3. It was confirmed by a high-voltage electron microscope that almost no dislocation lines were present in the tabular grains of Em-4.

(2) Chemical Sensitization

After sensitizing dyes ExS-1, ExS-2, and ExS-3 were added at a molar ratio of 60:3:37 to the emulsions Em-1 to Em-5 thus prepared, the resultant emulsions were subjected to gold-sulfur-selenium sensitization by controlling sodium thiosulfate, chloroauric acid, a selenium sensitizer represented by compound-21, and potassium thiocyanate to their respective optimal amounts. A gold-sulfur-sensitized emulsion was also prepared from the emulsion Em-3 by omitting the addition of the selenium sensitizer from the above process.

(3) Making and Evaluation of Coated Samples

Emulsion and protective layers were coated in amounts as shown in Table 1 below on triacetylcellulose supports having subbing layers, thereby making samples 1 to 18 as listed in Table 2 below.

TABLE 1

| Emulsion coating conditions | |
|---|---|
| (1) Emulsion layer | |
| Emulsion . . . several different emulsions | (silver $3.6 \times 10^{-2}$ mole/m$^2$) |
| Coupler | ($1.5 \times 10^{-3}$ mole/m$^2$) |

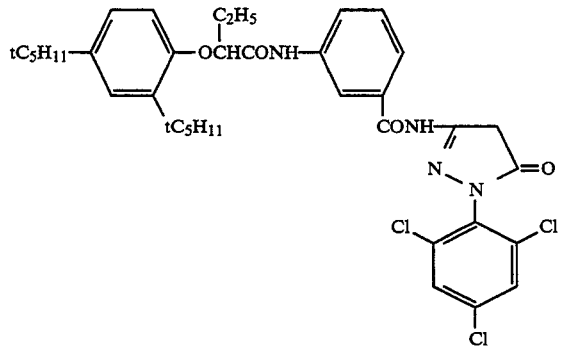

| | |
|---|---|
| Tricresylphosphate | (1.10 g/m$^2$) |
| Gelatin | (2.30 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

TABLE 2

| Sample name | Emulsion No. | Grain shape | Average aspect ratio | Dislocations | Chemical sensitization | Polymer of present invention | Addition amount (per mole of silver) | Addition amount (per 100 g of gelatin) | Remarks |
|---|---|---|---|---|---|---|---|---|---|
| Sample | | | | | | | | | |
| 1 | Em-1 | Potato-like | 1.5 | Found | Gold-Sulfur. selenium | None | — | | Comparative example |
| 2 | " | Potato-like | " | " | Gold-Sulfur. selenium | P-2 | 2.9 g | | Comparative example |
| 3 | Em-2 | Tabular | 3.5 | " | Gold-Sulfur. selenium | None | — | | Comparative example |
| 4 | " | " | " | " | Gold- | P-2 | 2.9 g | | Present |

TABLE 2-continued

| Sample name | Emulsion No. | Grain shape | Average aspect ratio | Dislocations | Chemical sensitization | Polymer of present invention | Addition amount (per mole of silver) | Addition amount (per 100 g of gelatin) | Remarks |
|---|---|---|---|---|---|---|---|---|---|
| | | | | | Sulfur. selenium | | | | Invention |
| 5 | Em-3 | " | 6.0 | " | Gold-Sulfur. selenium | None | — | | Comparative example |
| 6 | " | " | " | " | Gold-Sulfur. selenium | P-2 | 0.7 mg | | Comparative example |
| 7 | " | " | " | " | Gold-Sulfur. selenium | " | 0.3 g | | Present Invention |
| 8 | " | " | " | " | Gold-Sulfur. selenium | " | 2.9 g | | Present Invention |
| 9 | " | " | " | " | Gold-Sulfur. selenium | " | 10 g | | Present Invention |
| 10 | " | " | " | " | Gold-Sulfur. selenium | " | 29 g | | Comparative example |
| 11 | " | " | " | " | Gold-Sulfur. selenium | P-5 | 2.9 g | | Present Invention |
| 12 | " | " | " | " | Gold-Sulfur. selenium | P-10 | 2.9 g | | Present Invention |
| 13 | Em-3 | Tabular | 6.0 | Found | Gold-Sulfur | None | — | | Comparative example |
| 14 | " | " | " | " | Gold-Sulfur | P-2 | 2.9 g | | Present Invention |
| 15 | Em-4 | " | " | None | Gold-Sulfur. selenium | None | — | | Comparative example |
| 16 | " | " | " | " | Gold-Sulfur. selenium | P-2 | 2.9 g | | Present Invention |
| 17 | Em-5 | " | 15.0 | " | Gold-Sulfur. selenium | None | — | | Comparative example |
| 18 | " | " | " | " | Gold-Sulfur. selenium | P-2 | 2.9 g | | Present Invention |

These samples were subjected to sensitometry red exposure at a color temperature of 4,800°K for 1/100 second through a continuous wedge and to the following color development.

The development was performed under the following conditions.

| Step | Time | Temperature | Quantity of replenisher | Tank volume |
|---|---|---|---|---|
| Color development | 2 min. 45 sec. | 38° C. | 33 ml | 20 l |
| Bleaching | 6 min. 30 sec. | 38° C. | 25 ml | 40 l |
| Washing | 2 min. 10 sec. | 24° C. | 1,200 ml | 20 l |
| Fixing | 4 min. 20 sec. | 38° C. | 25 ml | 30 l |
| Washing (1) | 1 min. 05 sec. | 24° C. | Counter flow piping from (2) to (1) | 10 l |
| Washing (2) | 1 min. 00 sec. | 24° C. | 1,200 ml | 10 l |
| Stabilization | 1 min. 05 sec. | 38° C. | 25 ml | 10 l |
| Drying | 4 min. 20 sec. | 55° C. | | |

The quantity of replenisher is represented by a value per meter of a 35-mm wide sample.

The compositions of the processing solutions will be presented below.

-continued

| (Color developing solution) | solution (g) | (g) |
|---|---|---|
| Diethylenetriamine-pentaacetate | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxyethylamino)-2-methylaniline sulfate | 4.5 | 5.5 |
| Water to make | 1.0 l | 1.0 l |
| pH | 10.05 | 10.10 |

| (Bleaching solution) | Mother solution (g) | Replenisher (g) |
|---|---|---|
| Ferric Sodium ethylenediamine-tetraacetate trihydrate | 100.0 | 120.0 |
| Disodium ethylene-diaminetetraacetate | 10.0 | 11.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |

| | Mother | Replenisher |
|---|---|---|

-continued

| (Fixing solution) | solution (g) | (g) |
|---|---|---|
| Disodium ethylene-diaminetetraacetate | 0.5 | 0.7 |
| Ammonium sulfite | 7.0 | 8.0 |
| Sodium bisulfite | 5.0 | 5.5 |
| Aqueous ammonium thiosulfate solution (70%) | 170.0 ml | 200.0 ml |
| Water to make | 1.0 l | 1.0 l |
| pH | 6.7 | 6.6 |

| (Stabilizing solution) | Mother solution (g) | Replenisher (g) |
|---|---|---|
| Formalin (37%) | 2.0 ml | 3.0 ml |
| Polyoxyethylene-p-monononylphenylether (average degree of polymerization 10) | 0.3 | 0.45 |
| Disodium ethylenediamine-tetraacetate | 0.05 | 0.08 |
| Water to make | 1.0 l | 1.0 l |
| pH | 5.8–8.0 | 5.8–8.0 |

The densities of the samples thus processed were measured through a green filter.

The obtained sensitivity, fog, and gradation were evaluated. The sensitivity was represented by a relative value of the reciprocal of an exposure amount required for an optical density to become higher than fog by 0.2.

The evaluation results are summarized in Table 3 below.

Table 3 shows data obtained when the coating solution was aged at 40° C. for 30 minutes after the preparation and data obtained when the coating solution was aged at 40° C. for three hours after the preparation.

TABLE 3

| Sample name | After aging for 30 minutes in the form of solution | | | After aging for 3 hours in the form of solution | | | Remarks |
|---|---|---|---|---|---|---|---|
| | Fog | Sensitivity | Gradation | Fog | Sensitivity | Gradation | |
| Sample | | | | | | | |
| 1 | 0.15 | 100 | 1.85 | 0.14 | 100 | 1.85 | Comparative example |
| 2 | 0.13 | 95 | 1.80 | 0.12 | 95 | 1.80 | Comparative example |
| 3 | 0.18 | 130 | 1.95 | 0.20 | 115 | 1.65 | Comparative example |
| 4 | 0.17 | 130 | 2.00 | 0.17 | 130 | 1.95 | Present Invention |
| 5 | 0.20 | 145 | 1.90 | 0.22 | 120 | 1.50 | Comparative example |
| 6 | 0.20 | 145 | 1.90 | 0.21 | 125 | 1.60 | Comparative example |
| 7 | 0.19 | 145 | 1.95 | 0.19 | 140 | 1.90 | Present Invention |
| 8 | 0.18 | 150 | 2.00 | 0.18 | 150 | 2.00 | Present Invention |
| 9 | 0.17 | 145 | 1.90 | 0.16 | 145 | 1.90 | Present Invention |
| 10 | 0.16 | 95 | 1.60 | 0.15 | 95 | 1.60 | Comparative example |
| 11 | 0.19 | 145 | 1.90 | 0.19 | 140 | 1.80 | Present Invention |
| 12 | 0.18 | 150 | 1.90 | 0.18 | 145 | 1.85 | Present Invention |
| 13 | 0.18 | 125 | 1.80 | 0.18 | 110 | 1.45 | Comparative example |
| 14 | 0.18 | 125 | 1.85 | 0.17 | 120 | 1.80 | Present Invention |
| 15 | 0.20 | 110 | 2.05 | 0.21 | 100 | 1.50 | Comparative example |
| 16 | 0.20 | 115 | 2.00 | 0.20 | 110 | 1.85 | Present Invention |
| 17 | 0.25 | 160 | 1.80 | 0.28 | 130 | 1.40 | Comparative example |
| 18 | 0.22 | 170 | 1.95 | 0.23 | 160 | 1.80 | Present Invention |

As can be seen from Table 3, although tabular grains exhibited preferable fresh photographic performance with high sensitivities, reduction in sensitivity and lowering of contrast occurred when the coating solution was aged. When adequate amounts of the polymers of the present invention were present, it was possible to obtain a high sensitivity and a high contrast in both fresh and aged photographic characteristics. The effect of the present invention was more remarkable when the aspect ratio of grains was high, dislocation lines were present in grains, and selenium sensitization was performed.

EXAMPLE 2

Tabular Silver Bromoiodide Emulsions

(1) Preparation of Emulsions

Tabular silver bromoiodide emulsion A (Process a)

While 1,200 ml of an aqueous solution containing 6.2 g of gelatin and 6.4 g of KBr were stirred at a temperature kept at 60° C., 8 cc of an aqueous 1.9M $AgNO_3$ solution and 9.6 cc of an aqueous 1.6M KBr solution were simultaneously added to the solution by a double-jet method over 45 seconds. After 38 g of gelatin were added to the resultant solution, the temperature was raised to 75° C., and the solution was ripened in the presence of $NH_3$ for 30 minutes. After the resultant solution was neutralized with $HNO_3$, 405 cc of an aqueous 1.9M $AgNO_3$ solution and an aqueous 1.9M KBr solution were added to the solution with the pAg kept at 8.10 while the flow rate was accelerated (such that the final flow rate was 10 times that at the beginning) over 87 minutes.

(Process b)

Thereafter, the temperature was decreased to 55° C., and 80 cc of an aqueous 0.3M KI solution were added to the resultant solution at a constant flow rate over one minute. Subsequently, 206 cc of an aqueous 1.9M $AgNO_3$ solution and 200 cc of an aqueous 2.0M KBr solution were added to the solution at a constant flow rate over 26 minutes. Thereafter, the resultant emulsion was cooled to 35° C. and washed by a conventional flocculation method. The obtained grains were found to be tabular grains having an average diameter as sphere of 1.3 μm. This was the same with the following tabular emulsions.

Tabular silver bromoiodide emulsion B

A tabular silver bromoiodide emulsion B was prepared following the same procedures as for the emulsion A except the following.

In the (process a), while 1,200 ml of the aqueous solution containing 6.2 g of gelatin and 6.4 g of KBr were stirred with the temperature kept at 30° C., instead of 60° C., 14.4 cc of an aqueous 1.0M $AgNO_3$ solution and 7.5 cc of an aqueous 2.0M KBr solution were simultaneously added to the solution by the double-jet method over 30 seconds, instead of 45 seconds.

In addition, in place of the ripening performed in the presence of $NH_3$ at 75° C. for 30 minutes, physical ripening was performed in the absence of $NH_3$ for 20 minutes.

In the (process b), the aqueous 0.3M KI solution was added in an amount of 126 cc, instead of 80 cc, at a constant flow rate over one minute.

Tabular silver bromoiodide emulsion C

A tabular silver bromoiodide emulsion C was prepared following the same procedures as for the emulsion B except the following.

In the (process b), after an aqueous sodium p-iodoacetamidobenzenesulfonate (14.2 g) solution was added, 55 cc of an aqueous 0.8M sodium sulfite solution were added to the resultant solution at a constant flow rate over one minute, thereafter, the pH was kept at 9.0 for eight minutes and then returned to 5.6, instead of the addition of 126 cc of the aqueous 0.3M KI solution at a constant flow rate over one minute.

Tabular silver bromoiodide emulsion D

A tabular silver bromoiodide emulsion D was prepared following the same procedures as for the emulsion C except the following.

In the (process a), 48 cc of an aqueous 0.1M $AgNO_3$ solution, instead of 14.4 cc of the aqueous 1.0M $AgNO_3$ solution, and 25 cc of an aqueous 0.2M KBr solution, instead of 7.5 cc of the aqueous 2.0M KBr solution, were simultaneously added by the double-jet method over 10 seconds.

In the (process b), after an aqueous sodium p-iodoacetamidobenzenesulfonate (19.3 g) solution was added, 75 cc of an aqueous 0.8M sodium sulfite solution were added to the resultant solution at a constant rate over one minute. Thereafter, the pH was kept at 9.0 for eight minutes and then returned to 5.6.

(2) Chemical Sensitization

The emulsions A to D were subjected to chemical sensitization as follows at a temperature of 60° C., pH 6.20, and pAg 8.40.

First, a sensitizing dye represented later was added in an amount at which 40% or 80% of the grain surface of each emulsion could be covered.

Subsequently, potassium thiocyanate, potassium chloroaurate, sodium thiosulfate, and a selenium sensitizer represented later were added in amounts of $3.0\times10^{-3}$ mole/moleAg, $6\times10^{-6}$ mole/moleAg, $1\times10^{-5}$ mole/moleAg, and $3\times10^{-6}$ mole, per mole of a silver halide, respectively, and ripening was performed at 60° C. such that a highest sensitivity could be obtained when exposure was performed for 1/100 second.

The emulsions A to D were divided into two groups in the process of redispersion after desalting: to one group of the emulsions, 70 g of dry gelatin per mole of silver was added and redispersed to prepare emulsions A-1 to D-1; and to other group of the emulsions, the polymers of the present invention in addition to 70 g of dry gelatin per mole of silver were added and redispersed, thereby preparing emulsions A-2, D-2, D-3, and D-4. The shapes of the tabular grains and the variation coefficients of the silver iodide contents are summarized in Table 4 below. Table 4 also shows the names and the addition amounts of the polymers of the present invention.

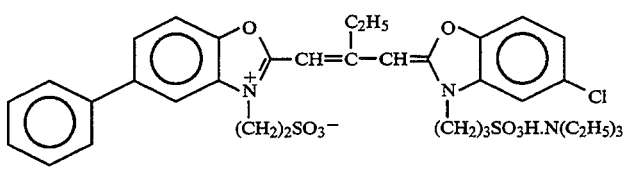

Sensitizing dye

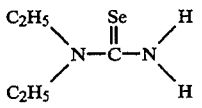

Selenium sensitizer

TABLE 4

| Emulsion name | Projected area (%) Aspect ratio of 8 or more | Projected area (%) Aspect ratio of 12 or more | Variation coefficient (%) of silver iodide contents of grains having aspect ratio of 8 or more | Synthetic polymer: Polymer of present invention | Synthetic polymer: Addition amount per mole of silver |
|---|---|---|---|---|---|
| A-1 | 10% | — | — | None | — |
| A-2 | " | — | — | P-2 | 2 g |
| B-1 | 75% | — | 23% | None | — |
| B-2 | " | — | " | P-2 | 2 g |
| C-1 | 75% | — | 12% | None | — |
| C-2 | " | — | " | P-2 | 2 g |
| D-1 | 95% | 75% | 14% | None | — |
| D-2 | " | " | " | P-2 | 2 g |
| D-3 | " | " | " | P-5 | 5 g |
| D-4 | " | " | " | P-10 | 5 g |

(3) Making and Evaluation of Coated Samples

The emulsions after the chemical sensitization were left to stand in the form of solutions for two hours. Thereafter, the emulsion and protective layers were coated in amounts listed in Table A on cellulose triacetate film supports having subbing layers.

TABLE A

| Emulsion coating conditions | |
|---|---|
| (1) Emulsion layer | |
| Emulsion . . . several different emulsions | (silver $3.6 \times 10^{-2}$ mole/m$^2$) |
| Coupler | ($1.5 \times 10^{-3}$ mole/m$^2$) |

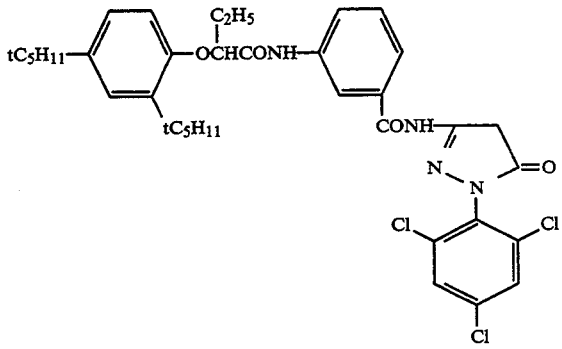

| | |
|---|---|
| Tricresylphosphate | (1.10 g/m$^2$) |
| Gelatin | (2.30 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours, exposed through a continuous wedge for 1/100 second, and subjected to color development shown in Table B below.

The densities of the samples thus processed were measured through a green filter.

TABLE B

| Step | Time | Temperature |
|---|---|---|
| Color development | 2 min. 00 sec. | 40° C. |
| Bleach-fixing | 3 min. 00 sec. | 40° C. |
| Washing (1) | 20 sec. | 35° C. |
| Washing (2) | 20 sec. | 35° C. |
| Stabilization | 20 sec. | 35° C. |

TABLE B-continued

| Step | Time | Temperature |
|---|---|---|
| Drying | 50 sec. | 65° C. |

The compositions of the individual processing solutions are given below.

| | (g) |
|---|---|
| (Color developing solution) | |
| Diethylenetriaminepentaacetate | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |
| Water to make | 1.0 l |
| pH | 10.05 |
| (Bleach-fixing solution) | |
| Ferric ammonium ethylenediamine-tetraacetate dihydrate | 90.0 |
| Disodium ethylenediaminetetraacetate | 5.0 |
| Sodium sulfite | 12.0 |
| Aqueous ammonium thiosulfate solution (70%) | 260.0 ml |
| Acetic acid (98%) | 5.0 ml |
| Bleaching accelerator | 0.01 mole |

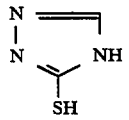

| | |
|---|---|
| Water to make | 1.0 l |
| pH | 6.0 |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 1.5 g/l of sodium sulfate were added.

The pH of the solution ranged from 6.5 to 7.5.

| (Stabilizing solution) | (g) |
|---|---|
| Formalin (37%) | 2.0 ml |

-continued

| (Stabilizing solution) | (g) |
|---|---|
| Polyoxyethylene-p-monononylphenylether (average polymerization degree = 10) | 0.3 |
| Disodium ethylenediaminetetraacetate | 0.05 |
| Water to make | 1.0 l |
| pH | 5.0–8.0 |

The sensitivity is represented by a relative value of the logarithm of the reciprocal of an exposure amount (lux·sec) at which a density of fog+0.2 is given. The granularity is represented in terms of an RMS value. The results are summarized in Table 5 below.

TABLE 5

| Sample name | Emulsion name | Average aspect ratio | Polymer of present invention | Dye covering rate | Fog | Sensitivity | RMS granularity | Remarks |
|---|---|---|---|---|---|---|---|---|
| 101 | A-1 | 5.5 | None | 40% | 0.20 | 100 | 0.024 | Comparative Example |
| 102 | A-1 | 5.5 | None | 80 | 0.18 | 170 | 0.024 | |
| 103 | A-2 | 5.5 | P-2 | 40 | 0.20 | 110 | 0.024 | Present Invention |
| 104 | A-2 | 5.5 | P-2 | 80 | 0.19 | 180 | 0.023 | |
| 105 | B-1 | 11 | None | 40 | 0.22 | 145 | 0.027 | Comparative Example |
| 106 | B-1 | 11 | None | 80 | 0.21 | 260 | 0.033 | |
| 107 | B-2 | 11 | P-2 | 40 | 0.21 | 155 | 0.026 | Present Invention |
| 108 | B-2 | 11 | P-2 | 80 | 0.20 | 280 | 0.026 | |
| 109 | C-1 | 11 | None | 40 | 0.21 | 155 | 0.026 | Comparative Example |
| 110 | C-1 | 11 | None | 80 | 0.21 | 270 | 0.031 | |
| 111 | C-2 | 11 | P-2 | 40 | 0.20 | 160 | 0.024 | Present Invention |
| 112 | C-2 | 11 | P-2 | 80 | 0.20 | 290 | 0.023 | |
| 113 | D-1 | 18 | None | 40 | 0.23 | 190 | 0.027 | Comparative Example |
| 114 | D-1 | 18 | None | 80 | 0.22 | 330 | 0.035 | |
| 115 | D-2 | 18 | P-2 | 40 | 0.22 | 200 | 0.027 | Present Invention |
| 116 | D-2 | 18 | P-2 | 80 | 0.20 | 360 | 0.026 | |
| 117 | D-3 | 18 | P-5 | 40 | 0.21 | 210 | 0.028 | Present Invention |
| 118 | D-3 | 18 | P-5 | 80 | 0.20 | 370 | 0.027 | |
| 119 | D-4 | 18 | P-10 | 40 | 0.22 | 190 | 0.026 | Present Invention |
| 120 | D-4 | 18 | P-10 | 80 | 0.21 | 350 | 0.025 | |

As can be seen from the results shown in Table 5, no change was found in granularity of the emulsion (A-1) having an average aspect ratio of 5.5 even when the dye covering rate was increased from 40% to 80%. In the emulsion (B-1) having an average aspect ratio of 11, however, degradation of granularity occurred when the dye amount was increased, although the emulsion preferably had a high sensitivity. The emulsion (B-2) containing the polymer of the present invention had a high sensitivity and did not cause degradation of granularity even when the dye amount was increased. The emulsion (C-2) having an aspect ratio of 11 and a small variation coefficient in silver iodide content exhibited more preferable sensitivity and granularity. The emulsion (D-1) having a higher aspect ratio had a very high sensitivity, but degradation of granularity was significant with the increasing dye amount. The emulsions (D-2) to (D-4) containing the polymers of the present invention were able to achieve both high sensitivities and low RMS values.

EXAMPLE 3

Emulsions used in the samples 2, 4, 5, 8, and 18 of Example 1 were used to prepare the coating solutions having the compositions of the fourth layer of the multi-layered color light-sensitive material presented below, and the resultant solutions were aged at 40° C. for three hours. Thereafter, these solutions were coated on subbed cellulose triacetate film supports to make samples 201 to 205.

(Compositions of light-sensitive layers)

The main materials used in the individual layers are classified as follows.

| | |
|---|---|
| ExC: Cyan coupler | UV: Ultraviolet absorbent |
| ExM: Magenta coupler | HBS: High-boiling organic solvent |
| ExY: Yellow coupler | H: Gelatin hardener |
| ExS: Sensitizing dye | |

The number corresponding to each component indicates the coating amount in units of g/m$^2$. The coating amount of a silver halide is represented by the amount of silver. The coating amount of each sensitizing dye is represented in units of moles per mole of a silver halide in the same layer.

| (Samples 201–205) | | |
|---|---|---|
| 1st layer (Antihalation layer) | | |
| Black colloidal silver | silver | 0.18 |
| Gelatin | | 1.40 |
| ExM-1 | | 0.18 |
| ExF-1 | | $2.0 \times 10^{-3}$ |
| HBS-1 | | 0.20 |
| 2nd layer (Interlayer) | | |
| Emulsion G | silver | 0.065 |
| 2,5-di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |
| 3rd layer | | |

-continued (Samples 201–205)

| | | |
|---|---|---|
| (Low-speed red-sensitive emulsion layer) | | |
| Emulsion A | silver | 0.25 |
| Emulsion B | silver | 0.25 |
| ExS-1 | | $6.9 \times 10^{-5}$ |
| ExS-2 | | $1.8 \times 10^{-5}$ |
| ExS-3 | | $3.4 \times 10^{-4}$ |
| ExC-1 | | 0.17 |
| ExC-3 | | 0.030 |
| ExC-4 | | 0.10 |
| ExC-5 | | 0.020 |
| ExC-7 | | 0.0050 |
| ExC-8 | | 0.010 |
| Cpd-2 | | 0.025 |
| HBS-1 | | 0.10 |
| Gelatin | | 0.87 |
| 4th layer (Medium-speed red-sensitive emulsion layer) | | |
| Emulsion (emulsions used in samples 2, 4, 5, 8, and 18) | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.025 |
| ExC-7 | | 0.0010 |
| ExC-8 | | 0.0070 |
| Cpd-2 | | 0.023 |
| HBS-1 | | 0.10 |
| Gelatin | | 0.75 |
| 5th layer (High-speed red-sensitive emulsion layer) | | |
| Emulsion E | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.12 |
| ExC-3 | | 0.045 |
| ExC-6 | | 0.020 |
| ExC-8 | | 0.025 |
| Cpd-2 | | 0.050 |
| HBS-1 | | 0.22 |
| HBS-2 | | 0.10 |
| Gelatin | | 1.20 |
| 6th layer (Interlayer) | | |
| Cpd-1 | | 0.10 |
| HBS-1 | | 0.50 |
| Gelatin | | 1.10 |
| 7th layer (Low-speed green-sensitive emulsion layer) | | |
| Emulsion C | silver | 0.35 |
| ExS-4 | | $3.0 \times 10^{-5}$ |
| ExS-5 | | $2.1 \times 10^{-4}$ |
| ExS-6 | | $8.0 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| 8th layer (Medium-speed green-sensitive emulsion layer) | | |
| Emulsion D | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExM-2 | | 0.13 |
| ExM-3 | | 0.030 |
| ExY-1 | | 0.018 |
| HBS-1 | | 0.16 |
| HBS-3 | | $8.0 \times 10^{-3}$ |

-continued (Samples 201–205)

| | | |
|---|---|---|
| Gelatin | | 0.90 |
| 9th layer (High-speed green-sensitive emulsion layer) | | |
| Emulsion E | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.030 |
| ExM-4 | | 0.040 |
| ExM-5 | | 0.019 |
| Cpd-3 | | 0.040 |
| HBS-1 | | 0.25 |
| HBS-2 | | 0.10 |
| Gelatin | | 1.44 |
| 10th layer (Yellow filter layer) | | |
| Yellow colloidal silver | silver | 0.030 |
| Cpd-1 | | 0.16 |
| HBS-1 | | 0.60 |
| Gelatin | | 0.60 |
| 11th layer (Low-speed blue-sensitive emulsion layer) | | |
| Emulsion C | silver | 0.18 |
| ExS-7 | | $8.6 \times 10^{-4}$ |
| ExY-1 | | 0.020 |
| ExY-2 | | 0.022 |
| ExY-3 | | 0.050 |
| ExY-4 | | 0.020 |
| HBS-1 | | 0.28 |
| Gelatin | | 1.10 |
| 12th layer (Medium-speed blue-sensitive emulsion layer) | | |
| Emulsion D | silver | 0.40 |
| ExS-7 | | $7.4 \times 10^{-4}$ |
| ExC-7 | | $7.0 \times 10^{-3}$ |
| ExY-2 | | 0.050 |
| ExY-3 | | 0.10 |
| HBS-1 | | 0.050 |
| Gelatin | | 0.78 |
| 13th layer (High-speed blue-sensitive emulsion layer) | | |
| Emulsion F | silver | 1.00 |
| ExS-7 | | $4.0 \times 10^{-4}$ |
| ExY-2 | | 0.10 |
| ExY-3 | | 0.10 |
| HBS-1 | | 0.070 |
| Gelatin | | 0.86 |
| 14th layer (1st protective layer) | | |
| Emulsion G | silver | 0.20 |
| UV-4 | | 0.11 |
| UV-5 | | 0.17 |
| HBS-1 | | $5.0 \times 10^{-2}$ |
| Gelatin | | 1.00 |
| 15th layer (2nd protective layer) | | |
| H-1 | | 0.40 |
| B-1 (diameter 1.7 μm) | | $5.0 \times 10^{-2}$ |
| B-2 (diameter 1.7 μm) | | 0.10 |
| B-3 | | 0.10 |
| S-1 | | 0.20 |
| Gelatin | | 1.20 |

In addition to the above components, to improve storage stability, processability, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, and rhodium salt.

The emulsions represented by the symbols are listed in Table 6 below and a list of the compounds used will be given later.

TABLE 6

| Emulsion | Average AgI content | Average grain size (μm) | Variation coefficient (%) according to grain size | Diameter/thickness ratio | Silver amount ratio [core/intermediate/shell] (AgI content) | Grain structure/shape |
|---|---|---|---|---|---|---|
| A | 4.0 | 0.45 | 27 | 1 | [⅓](13/1) | Double structure octahedral grain |
| B | 8.9 | 0.70 | 14 | 1 | [3/7](25/2) | Double structure octahedral grain |
| C | 2.0 | 0.55 | 25 | 7 | — | Uniform structure tabular grain |
| D | 9.0 | 0.65 | 25 | 6 | [12/59/29](0/11/8) | Triple structure tabular grain |
| E | 9.0 | 0.85 | 23 | 5 | [8/59/33](0/11/8) | Triple structure tabular grain |
| F | 14.5 | 1.25 | 25 | 3 | [37/63](34/3) | Double structure tabular grain |
| G | 1.0 | 0.07 | 15 | 1 | — | Uniform structure fine grain |

In Table 6, (1) The emulsions A to F were subjected to reduction sensitization during grain preparation by using thiourea dioxide and thiosulfonic acid in accordance with the embodiments in JP-A-2-191938.

(2) The emulsions A to F were subjected to gold sensitization, sulfur sensitization, and selenium sensitization in the presence of the spectral sensitizing dyes described in the individual light-sensitive layers and sodium thiocyanate in accordance with the embodiments in JP-A-3-237450.

(3) The preparation of tabular grains was performed by using low-molecular weight gelatin in accordance with the embodiments in JP-A-1-158426.

(4) Dislocation lines as described in JP-A-3-237450 were observed in tabular grains and regular crystal grains having a grain structure when a high-voltage electron microscope was used.

(5) The emulsions A to F were silver bromoiodide emulsions.

ExC-1

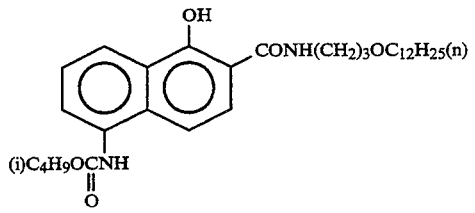

ExC-2

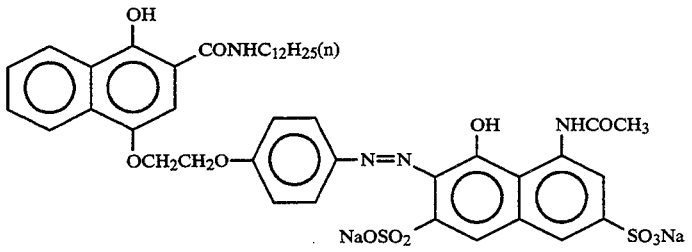

ExC-3

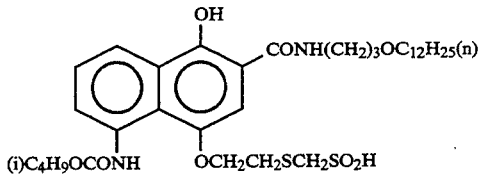

ExC-4

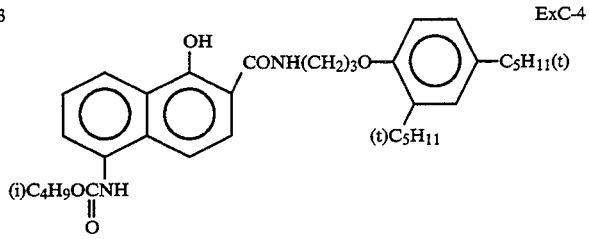

-continued
ExC-5
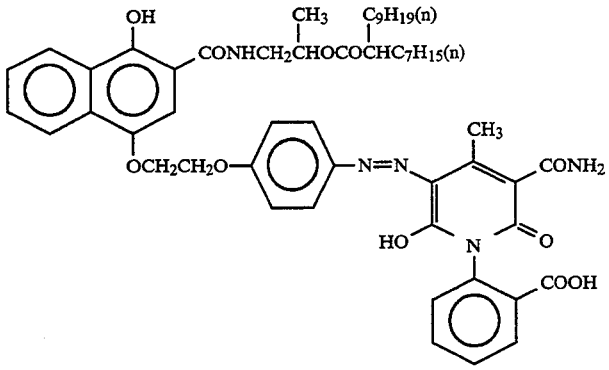
ExC-6
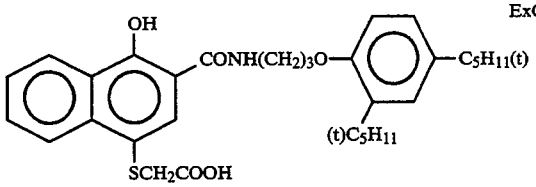
ExC-7
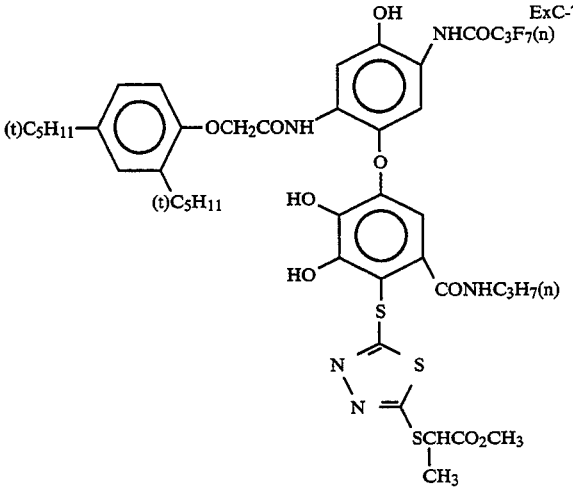
ExC-8
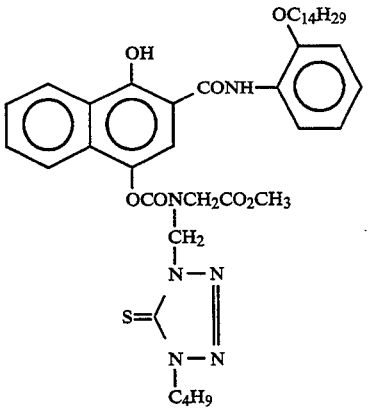
ExM-1
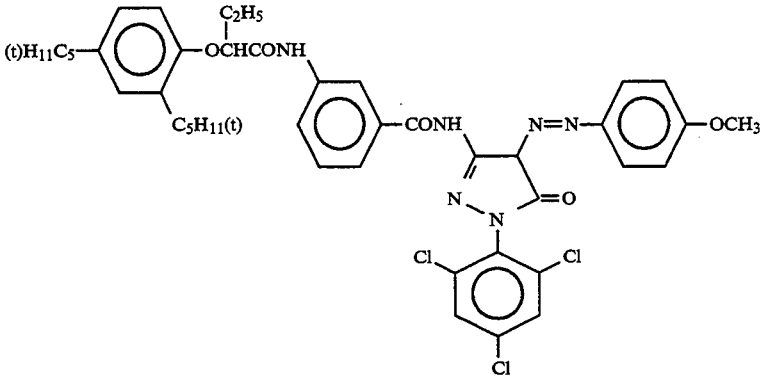

-continued
ExM-2
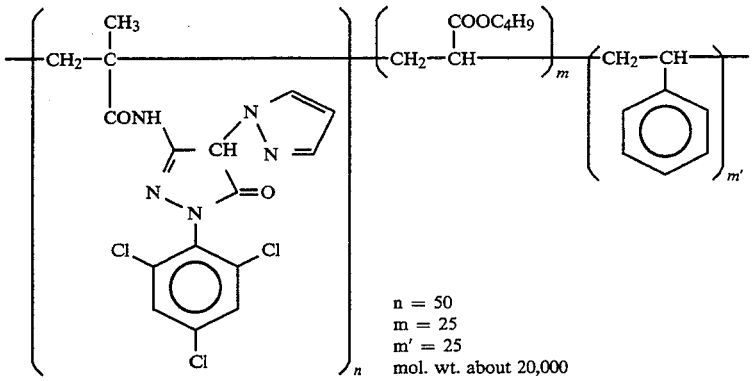
ExM-3
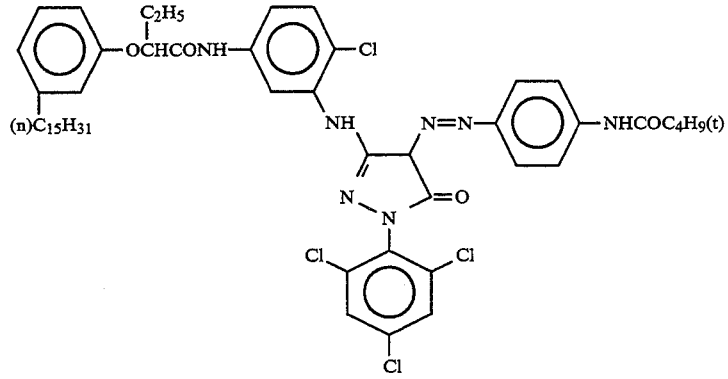
ExM-4
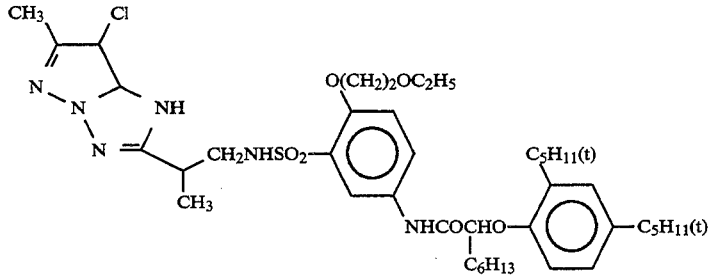
ExM-5
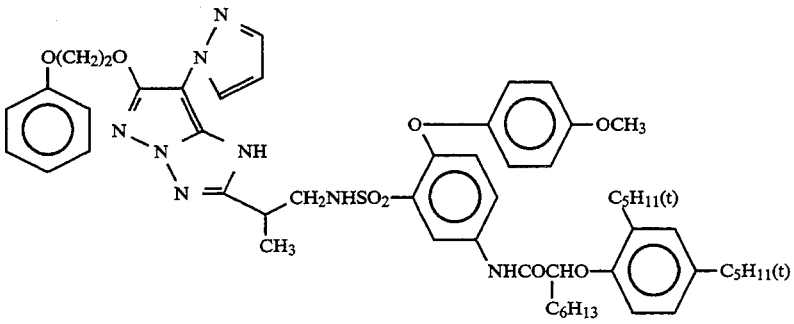
ExY-1
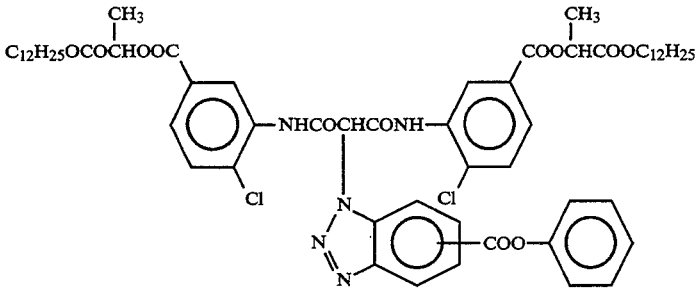

-continued
ExY-2
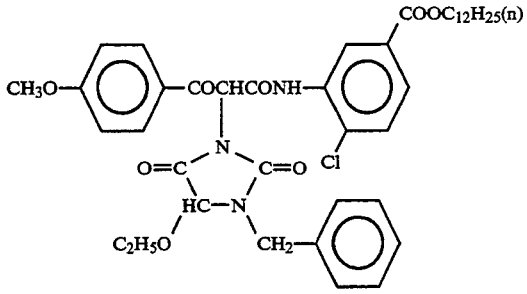
ExY-3
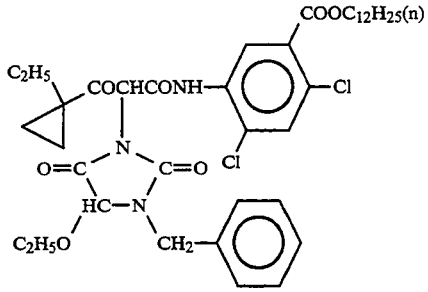
ExY-4
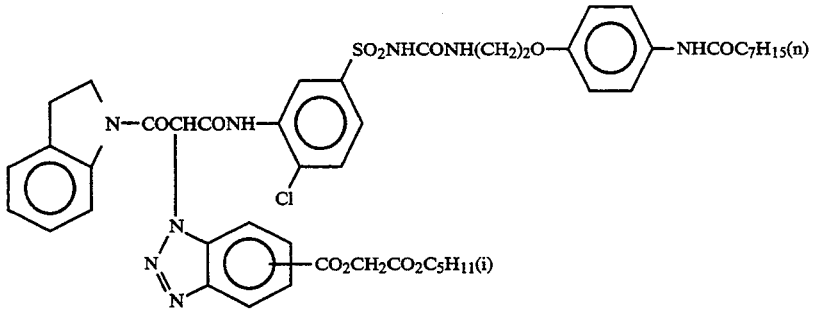
UV-1
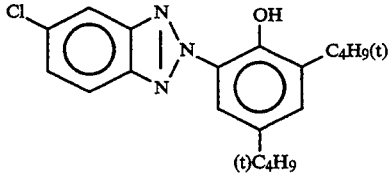
UV-2
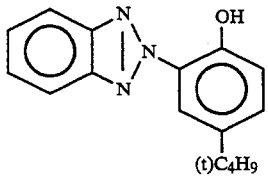
UV-3
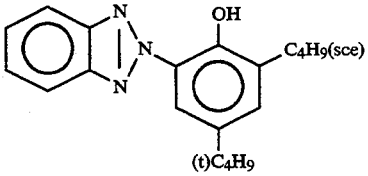
UV-4
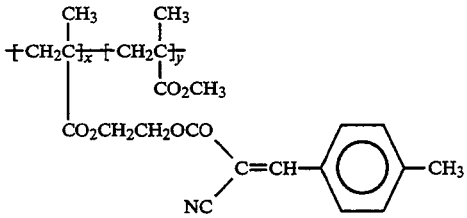
x:y = 70:30 (wt %)
UV-5
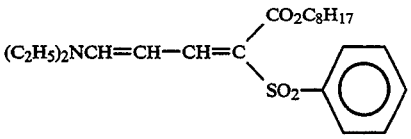
tricresylphosphate HBS-1
di-n-butylphthalate HBS-2
HBS-3
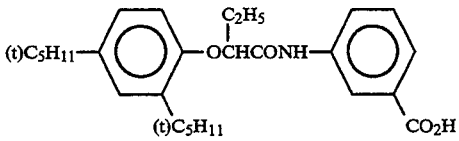
ExS-1
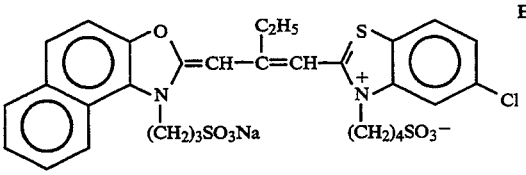
ExS-2
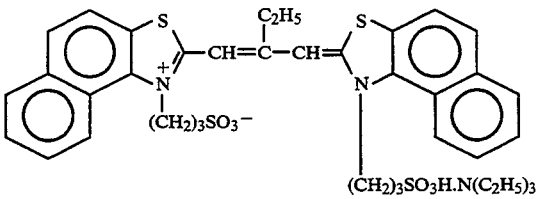

-continued
ExS-3
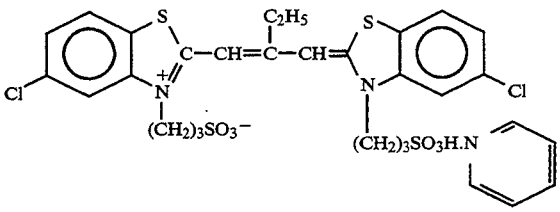
ExS-4
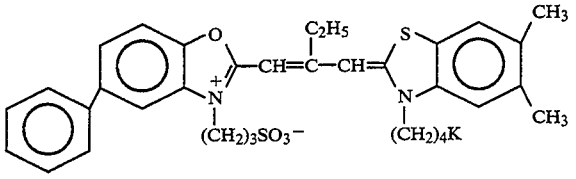
ExS-5
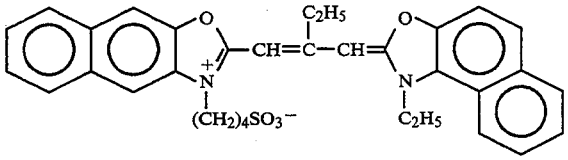
ExS-6
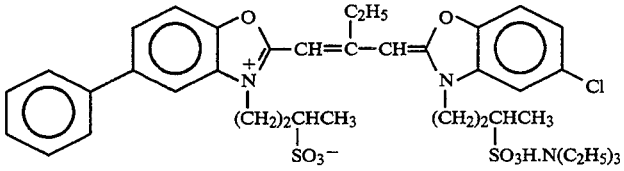
ExS-7
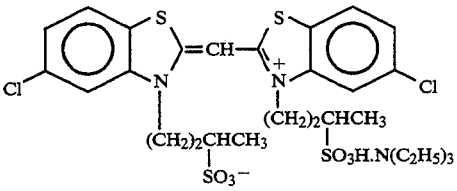
S-1
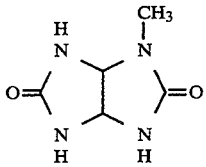
H-1
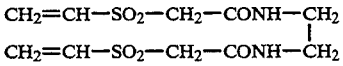
B-1
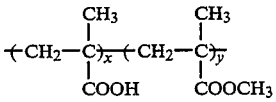
x/y = 10/90
B-2
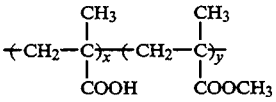
x/y = 40/60
B-3
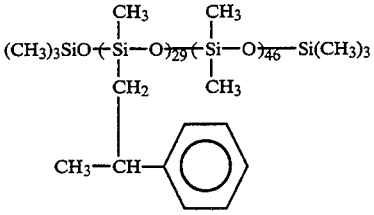
B-4
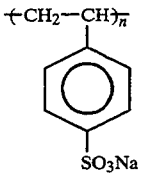
F-1
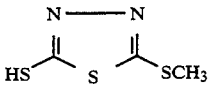
F-2
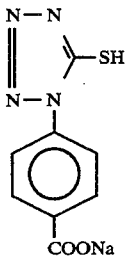
F-3
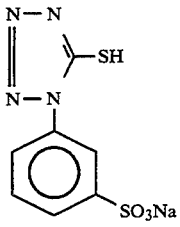

-continued

F-4

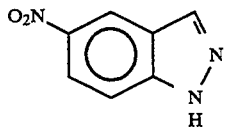

F-5

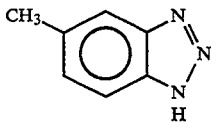

F-6

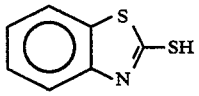

F-7

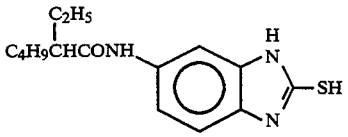

F-8

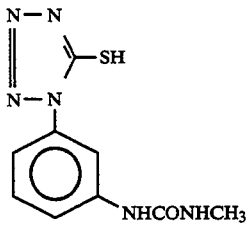

F-9

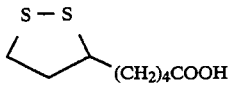

F-10

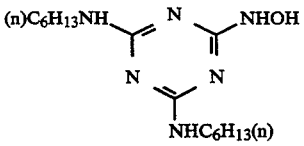

F-11

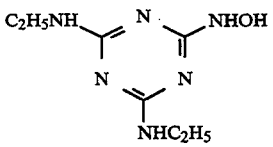

F-12

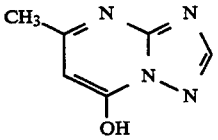

F-13

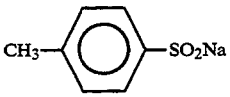

F-14

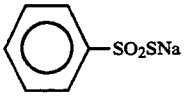

F-15

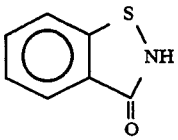

F-16

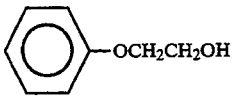

F-17

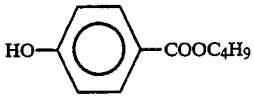

The samples 201 to 205 as color photographic light-sensitive materials were exposed for sensitometry and processed by the method described below.

| Step | (Processing Method) Time | Temperature |
|---|---|---|
| Color development | 3 min. 15 sec. | 38° C. |
| Bleaching | 1 min. 00 sec. | 38° C. |
| Bleach-fixing | 3 min. 15 sec. | 38° C. |
| Washing (1) | 40 sec. | 35° C. |
| Washing (2) | 1 min. 00 sec. | 35° C. |
| Stabilization | 40 sec. | 38° C. |
| Drying | 1 min. 15 sec. | 55° C. |

The compositions of the individual processing solutions are given below.

| (Color developing solution) | (g) |
|---|---|
| Diethylenetriaminepentaacetate | 1.0 |
| 1-hydroxyethylidene-1,1-diphosphonic acid | 3.0 |

-continued

| | |
|---|---|
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |
| Water to make | 1.0 l |
| pH | 10.05 |

| (Bleaching solution) | (g) |
|---|---|
| Ferric ammonium ethylenediamine-tetraacetate dihydrate | 120.0 |
| Disodium ethylenediaminetetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mole |
| Ammonia water (27%) | 15.0 ml |
| Water to make | 1.0 l |
| pH | 6.3 |

| (Bleach-fixing solution) | (g) |
|---|---|
| Ferric ammonium ethylenediamine-tetraacetate dihydrate | 50.0 |

-continued

| | |
|---|---|
| Disodium ethylenediaminetetraacetate | 5.0 |
| Sodium sulfite | 12.0 |
| Aqueous ammonium thiosulfate solution (700 g/l) | 240.0 ml |
| Ammonia water (27%) | 6.0 ml |
| Water to make | 1.0 l |
| pH | 7.2 |

(Washing solution)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution ranged from 6.5 to 7.5.

| (Stabilizing solution) | (g) |
|---|---|
| Sodium p-toluenesulfinate | 0.03 |
| Polyoxyethylene-p-monononylphenylether (average polymerization degree 10) | 0.2 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 l |
| pH | 8.5 |

The samples 202, 204, and 205 of the multilayered color photographic light-sensitive materials of the present invention were found to have high sensitivities and high contrasts in a medium density region (density 0.5 to 1.5) on a characteristic curve of the red-sensitive layer compared to the samples 201 and 203 of the comparative examples. This demonstrates that the emulsions of the present invention have excellent characteristics even in a multi-layered color light-sensitive material.

What is claimed is:

1. A silver halide photographic light-sensitive material having at least one silver halide emulsion layer on a support, wherein at least one of said silver halide emulsion layers contains in the same emulsion layer both (i) a light-sensitive silver halide emulsion, in which tabular grains having an aspect ratio of 2 or more occupy 50% or more of a total projected area of silver halide grains, and (ii) a polymer represented by Formula (1) below in an amount of $10^{-3}$ to 10 g per mole of the silver halide:

$$\text{-}(A)_x\text{-}(B)_y\text{-} \qquad \text{Formula (1)}$$

wherein A represents a repeating unit derived from an ethylenic unsaturated monomer having at least one basic nitrogen atom, B represents a repeating unit, other than A, derived from an ethylenic unsaturated monomer, and x and y each represents a percentage by weight, x representing 0.1 to 100, and y representing 0 to 99.9.

2. The silver halide photographic light-sensitive material according to claim 1, wherein 60% or more (number) of said light-sensitive silver halide grains contain dislocation lines.

3. The silver halide photographic light-sensitive material according to claim 1, wherein said light-sensitive silver halide grains contained in said emulsion layer are subjected to selenium sensitization.

4. The silver halide photographic light-sensitive material according to claim 1, wherein said light-sensitive silver halide grains contained in said emulsion layer are sensitized with cyanine spectral sensitizing dyes.

5. The silver halide photographic light-sensitive material according to claim 1, wherein said polymer is represented by Formula (2) below:

$$\text{-}(A)_x\text{-}(B)_y\text{-} \qquad \text{Formula (2)}$$

wherein A represents a repeating unit derived from an ethylenic unsaturated monomer containing a heterocyclic group having at least one basic nitrogen atom in a ring thereof.

6. The silver halide photographic light-sensitive material according to claim 1, containing 0.1 to 5 g of said polymer represented by Formula (1) per 100 g of dry gelatin in said silver halide emulsion layer.

7. The silver halide photographic light-sensitive material according to claim 1, wherein tabular grains having an aspect ratio of 5 or more occupy 50% or more of the total projected area of said silver halide grains contained in said emulsion layer.

8. The silver halide photographic light-sensitive material according to claim 1, wherein 60% or more (number) of said light-sensitive silver halide grains contain not less than 10 dislocation lines per grain.

9. The silver halide photographic light-sensitive material according to claim 1, wherein said light-sensitive silver halide grains contained in said emulsion are subjected to both selenium sensitization and sulfur sensitization.

10. The silver halide photographic light-sensitive material according to claim 9, wherein said light-sensitive silver halide grains contained in said emulsion are chemically sensitized in the presence of cyanine spectral sensitizing dyes.

11. The silver halide photographic light-sensitive material according to claim 1, wherein tabular grains having an aspect ratio of 8 or more occupy 50% or more of the total projected area of said silver halide grains contained in said emulsion layer.

12. The silver halide photographic light-sensitive material according to claim 1, wherein said tabular grains contain silver iodide and a variation coefficient of a silver iodide content distribution between said tabular grains contained in said emulsion layer and having an aspect ratio of 8 or more is 20% or less.

13. The silver halide photographic light-sensitive material according to claim 1, wherein tabular grains having an aspect ratio of 12 or more occupy 50% or more of the total projected area of said silver halide grains contained in said emulsion layer.

14. The silver halide photographic light-sensitive material according to claim 5, wherein said polymer represented by Formula (2) contains 1 to 15% (percentage by weight) of a repeating unit derived from an ethylenic unsaturated monomer having an imidazole group on a side chain thereof.

15. The silver halide photographic light-sensitive material according to claim 14, wherein said polymer represented by Formula (2) contains 1 to 20% (percentage by weight) of a repeating unit derived from an ethylenic unsaturated monomer having a carboxylic acid or sulfonic acid group, or a salt thereof, as an anionic group.

16. The silver halide photographic light-sensitive material according to claim 15, wherein said polymer represented by Formula (2) contains 65 to 98% (percentage by weight) of a repeating unit derived from acrylamide, methacrylamide, and diacetoneacrylamide, in addition to said repeating unit derived from the ethylenic unsaturated monomer having an imidazole group on the side chain and said repeating unit derived from the ethylenic unsaturated group having the anionic group.

17. The silver halide photographic light-sensitive material according to claim 1, wherein the polymer represented by Formula (1) is present in an amount of $10^{-1}$ to 3 g per mole of the silver halide.

18. The silver halide photographic light-sensitive material according to claim 1, wherein the diameter of the tabular grain is 0.15 to 5.0 μm, and the thickness of the tabular grain is 0.05 to 1.0 μm.

19. The silver halide photographic light-sensitive material according to claim 1, wherein the aspect ratio is 6 or more, dislocation lines are present in at least some of said tabular grains, and selenium sensitization is performed on said tabular grains contained in said emulsion layer.

20. The silver halide photographic light-sensitive material according to claim 1, wherein said tabular grains having an aspect ratio of 5 or more occupy 50% or more of the total projected area of all silver halide grains, 60% (number) or more of the silver halide grains have 10 dislocation lines or more, and selenium sensitization is performed on said tabular grains contained in said emulsion layer.

* * * * *